US010071535B2

(12) United States Patent
Wetsch et al.

(10) Patent No.: US 10,071,535 B2
(45) Date of Patent: Sep. 11, 2018

(54) DUNNAGE SUPPLY DAISY CHAIN STABILIZER

(71) Applicant: PREGIS INNOVATIVE PACKAGING LLC, Dearfield, IL (US)

(72) Inventors: Thomas D. Wetsch, St. Charles, IL (US); Christopher M. Rains, New Lenox, IL (US); Christine S. Laub, Carol Stream, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 555 days.

(21) Appl. No.: 14/216,739

(22) Filed: Mar. 17, 2014

(65) Prior Publication Data

US 2014/0274647 A1 Sep. 18, 2014

Related U.S. Application Data

(60) Provisional application No. 61/799,819, filed on Mar. 15, 2013.

(51) Int. Cl.

| | |
|---|---|
| ***B31D 5/00*** | (2017.01) |
| ***B65H 16/04*** | (2006.01) |
| *B65H 20/26* | (2006.01) |

(52) U.S. Cl.

CPC ..... *B31D 5/0043* (2013.01); *B65H 20/26* (2013.01); *B65H 2301/3251* (2013.01); *B65H 2801/63* (2013.01)

(58) Field of Classification Search

CPC .. B31D 5/0043; B31D 5/0056; B31D 5/0065; B31D 2205/0023; B65H 20/26; B65H 2301/3251; B65H 2801/63

See application file for complete search history.

(56) References Cited

U.S. PATENT DOCUMENTS

| | | | | |
|---|---|---|---|---|
| 5,219,126 | A | 6/1993 | Schutz | |
| 6,179,765 | B1 * | 1/2001 | Toth | B26D 7/24 493/360 |

(Continued)

FOREIGN PATENT DOCUMENTS

| | | |
|---|---|---|
| JP | 11-286357 | 10/1999 |
| WO | 94/25380 A1 | 11/1994 |

OTHER PUBLICATIONS

PCT International Search Report and Written Opinion, PCT International Search Report and Written Opinion dated Jul. 7, 2014 for International Application No. PCT/US2014/030662, 29 pages.

*Primary Examiner* — William A. Rivera

(74) *Attorney, Agent, or Firm* — Dorsey & Whitney LLP

(57) ABSTRACT

A rolled sheet-material supply handling-system that comprises a drawing device that can be configured to draw sheet material from a supply station and a stabilizer at the supply station. The stabilizer can define a generally tubular roll-receiving space in which a roll of the sheet material can be received and can have a support surface that can define an axial opening leading from the roll-receiving space to receive the sheet material drawn therefrom by the drawing device. The support surface can be sufficiently extensive to stabilize the outer layer of a roll against collapsing when the remainder of the roll has been extracted from the axial opening.

34 Claims, 22 Drawing Sheets

(56) References Cited

U.S. PATENT DOCUMENTS

| | | | | |
|---|---|---|---|---|
| 6,756,096 | B2 | 6/2004 | Harding | |
| 6,910,997 | B1 * | 6/2005 | Yampolsky | B26F 1/22 493/350 |
| 7,350,741 | B1 * | 4/2008 | Rosa | B65H 75/265 242/403 |
| 7,651,455 | B2 * | 1/2010 | Yampolsky | B26F 1/22 493/407 |
| 7,789,819 | B2 * | 9/2010 | Slovencik | B26D 1/205 493/365 |
| 8,016,735 | B2 | 9/2011 | Wetsch et al. | |
| 2002/0139890 | A1 * | 10/2002 | Toth | B65H 16/08 242/421.3 |
| 2003/0073558 | A1 * | 4/2003 | Chesterson | B31D 5/0052 493/250 |
| 2008/0076653 | A1 * | 3/2008 | Shaw | B31D 5/006 493/464 |
| 2008/0261794 | A1 * | 10/2008 | Slovencik | B26D 1/205 493/370 |
| 2009/0258775 | A1 * | 10/2009 | Chan | B31D 5/0047 493/464 |
| 2011/0052875 | A1 | 3/2011 | Wetsch et al. | |
| 2012/0165172 | A1 | 6/2012 | Wetsch et al. | |
| 2013/0092716 | A1 | 4/2013 | Wetsch et al. | |
| 2014/0038805 | A1 * | 2/2014 | Wetsch | B31D 5/0043 493/464 |
| 2014/0274645 | A1 * | 9/2014 | Wetsch | B65H 35/008 493/360 |
| 2014/0274647 | A1 * | 9/2014 | Wetsch | B31D 5/0043 493/464 |

* cited by examiner

DUNNAGE SUPPLY DAISY CHAIN STABILIZER

CROSS REFERENCE TO RELATED APPLICATIONS

This application claims the priority to U.S. provisional application No. 61/799,819 entitled Dunnage Supply Daisy Chain Stabilizer, filed Mar. 15, 2013, the disclosure of which is hereby incorporated herein by reference in its entirety.

FIELD OF THE DISCLOSURE

The present disclosure relates generally to an arrangement for daisy chaining supply units of dunnage material.

BACKGROUND INFORMATION

In the context of paper-based protective packaging, rolls of paper sheet are crumpled to produce the dunnage. Most commonly, this type of dunnage is created by running a generally continuous strip of paper into a dunnage conversion machine that converts a compact supply of stock material, such as a roll or stack of paper, into a lower density dunnage material. The continuous strip of crumpled sheet material may be cut into desired lengths to effectively fill void space within a container holding a product. The dunnage material may be produced on an as needed basis for a packer. Examples of cushioning product machines that feed a paper sheet from an inside location of a roll are described in U.S. Patent Publication Nos. 2008/0076653, 2008/0261794, and 2012/0165172.

U.S. Patent Publication No. 2012/0165172 generally discloses a converter configured for pulling in a stream of sheet material and converting the material into dunnage. The publication further discloses that the supply units of sheets fed into the converter can be daisy chained together, with the end of one supply unit attached to the beginning of the next supply unit.

It would therefore be desirable to employ an apparatus and method of a supply handling system for stabilizing supply units to be fed into the dunnage conversion machines.

SUMMARY OF THE DISCLOSURE

In one embodiment, rolled sheet-material supply handling-system can comprise a drawing device that can be configured to draw sheet material from a supply station and a stabilizer at the supply station. The stabilizer can define a generally tubular roll-receiving space in which a roll of the sheet material can be received and can have a support surface that can define an axial opening leading from the roll-receiving space to receive the sheet material drawn therefrom by the drawing device. The support surface can be sufficiently extensive to stabilize the outer layer of a roll against collapsing when the remainder of the roll has been extracted from the axial opening.

The support surface can gently compresses against the outer layer of the roll to prevent collapsing of the roll when the remainder of the roll has been extracted from the axial opening. In some configurations, the stabilizer can be oriented generally upright, such that the axial opening is at the top of the stabilizer.

The support surface, in some configurations, can be disposed to support at least three points disposed in a coverage angle of more than half of roll-receiving space circumference to support the outer layer of the roll against collapsing. The coverage angle can be greater than about 270° in some configurations. In other configurations, the coverage angle is at least about 300°. The support surface can be substantially continuous over the circumferential coverage angle in some embodiments.

The support surface can be resiliently biased into the roll-receiving space to press on the outer layer of the roll. In some embodiments, a roll can be received in the roll-receiving space. The roll-receiving space can be substantially cylindrical and the support surface is radially biased to a circumference smaller than the roll.

In some embodiments, the stabilizer can comprise a support wall that can include the support surface and two opposed ends at opposite circumferential sides of the support surface. The ends can be resiliently movable with respect to each other and the roll-receiving space. The support wall can be flexible to allow the ends to move with respect to each other and the roll-receiving space. In some configurations, the opposed ends can be hinged with respect to each other to move with respect to each other and the roll-receiving space. In yet other embodiments, the support wall can be tubular with an open axial portion between the opposed ends.

The support surface can be biased inwardly into the roll receiving space sufficiently gently to gently press against the outer surface of the roll to support the outer layer of the roll against collapsing when the remainder of the roll has been extracted. The support surface, in some configurations, can be expandable to facilitate loading of the roll into the roll-receiving space. The support surface can also have an axial height sufficient to hold a plurality of rolls stacked on each other in the roll-receiving space.

The stabilizer can comprises a plurality of stabilizer units aligned coaxially with respect to each other, and each stabilizer unit is openable separately and independently from each other.

Some embodiments can have a plurality of rolls stacked coaxially in the roll receiving space and daisy chained to each other. The outer surface of the preceding one of the stacked rolls that can be daisy chained to a subsequent one of the stacked rolls being in supported contact with the support surface. Some embodiments can comprise a preceding and a subsequent second roll, the preceding roll received in the stabilizer, and an outer end of the preceding roll daisy chained to an inner end of the subsequent roll, the stabilizer supporting the outer layer of the preceding roll against collapsing when the remainder of the roll has been extracted. The subsequent roll can be received in the stabilizer. Additionally, in some embodiments, the rolls can be coreless.

Some embodiments of the handling system can include an adhesive strip that can adhere an inner end of one of the rolls to an outer end of a preceding one of the rolls. Some embodiments of the handling system can include a converting station that can be configured to convert the roll into low-density dunnage. The converting station can include the drawing device. The converting station in some embodiments can include a rotating drum configured for pulling and crushing the sheet material for converting the sheet material.

In other embodiments, a dunnage apparatus can comprise a converting station. The converting station can have a drawing device that can be configured to draw sheet material from a supply station and a converter that can have a rotating drum configured for pulling and crushing the sheet material for converting the sheet material into dunnage, and a stabilizer at the supply station that can define a roll-receiving space in which a roll of the sheet material is receivable and can have a support surface that defines an axial opening leading from the roll-receiving space to receive the sheet material drawn therefrom by the drawing device. The support surface can be sufficiently extensive to stabilize the outer layer of a roll to maintain a generally rolled configuration when the remainder of the roll has been extracted from the axial opening.

Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF THE DRAWINGS

Further features and advantages of the present disclosure will become apparent from the following detailed description taken in conjunction with the accompanying Figures showing illustrative embodiments of the present disclosure, in which.

Figure 1:
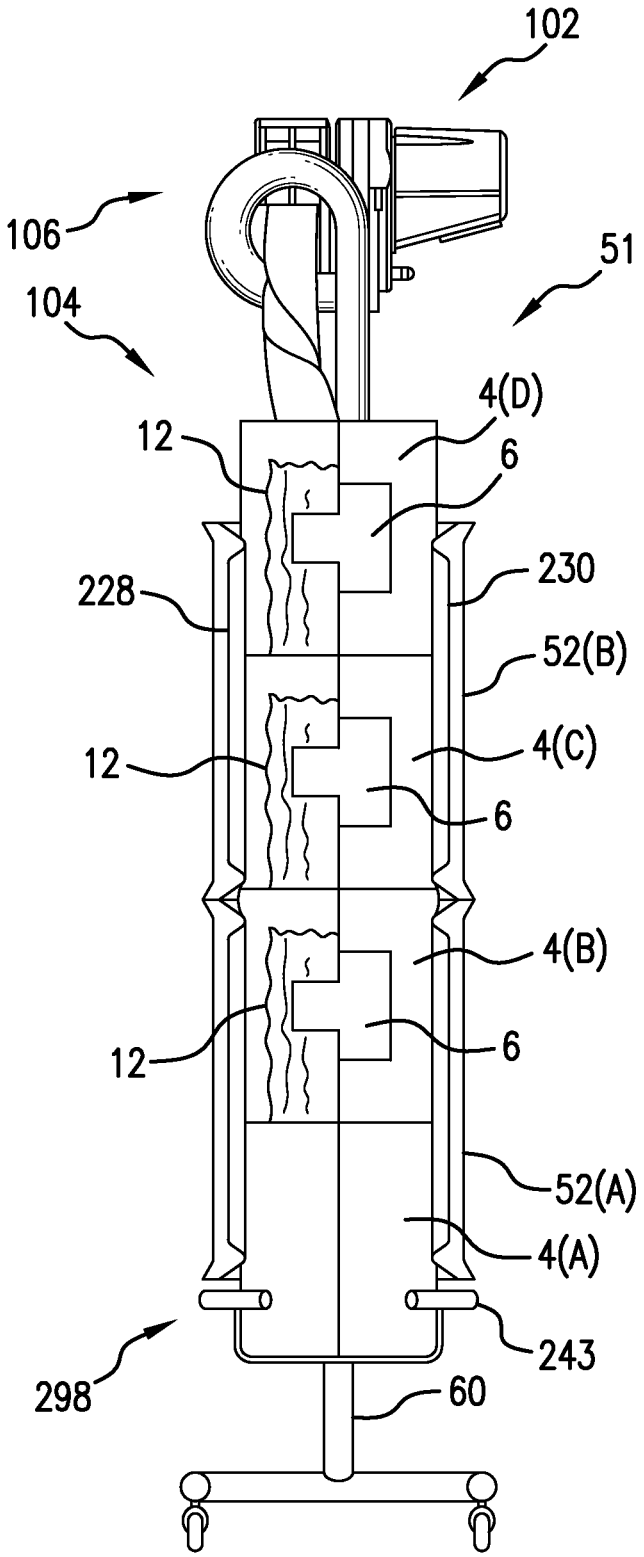
FIG. 1 is a rear view of an embodiment of a dunnage mechanism with a stabilizer for daisy chained stacks.

Throughout the drawings, the same reference numerals and characters, unless otherwise stated, are used to denote like features, elements, components, or portions of the illustrated embodiments. Moreover, while the present disclosure will now be described in detail with reference to the figures, it is done so in connection with the illustrative embodiments and is not limited by the particular embodiments illustrated in the figures.

DETAILED DESCRIPTION OF THE DISCLOSURE

The present disclosure is generally applicable to supply units for systems where the supply units are processed or converted. As shown in FIG. 1, the system 10 preferably includes a converting station 102, supply units 4 preferably daisy chained together by a sticker 6, and a stabilizer 8. A drawing device 106 is configured to draw sheet material from a supply station 104. The drawing device 106 is configured to pull a continuous stream of sheet material from one or more supply units, such as a daisy chained stream from a series of supply units, and the stream of sheet material is fed from the supply units into a converting station 102 to be converted into a low-density stock material, such as dunnage. In the preferred embodiment, the drawing device is the converting station 102, although in other configurations the drawing device can be separate from the converting station 102. One of the operating features of the system 10 is the production of a generally continuous supply of dunnage that can be severed as needed, to any length, and different lengths throughout use. By daisy chaining the supply units 4 together, a continuous and uninterrupted feed of material can be fed to the converting station 102.

Figure 2A:
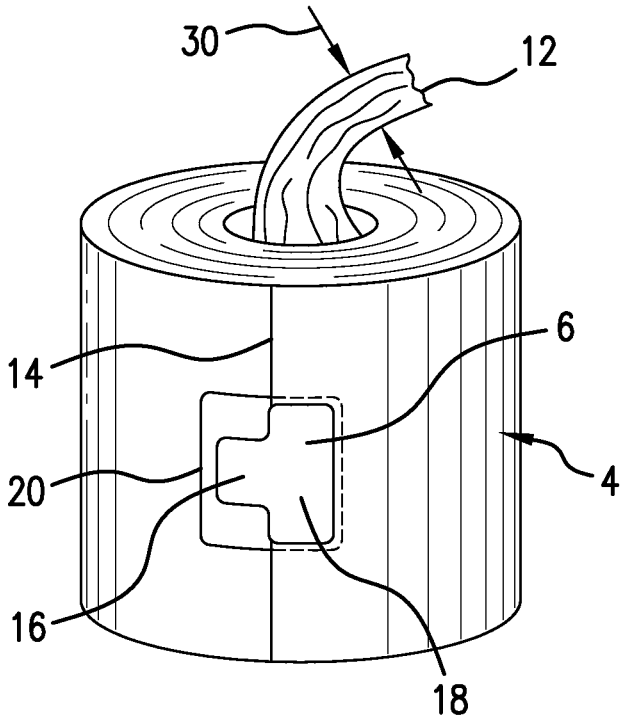
FIGS. 2A and 2B depict an exemplary embodiment of a dunnage supply unit with a daisy-chaining sticker respectively in an initial condition and with a connective member released from a release layer.
Figure 2B:
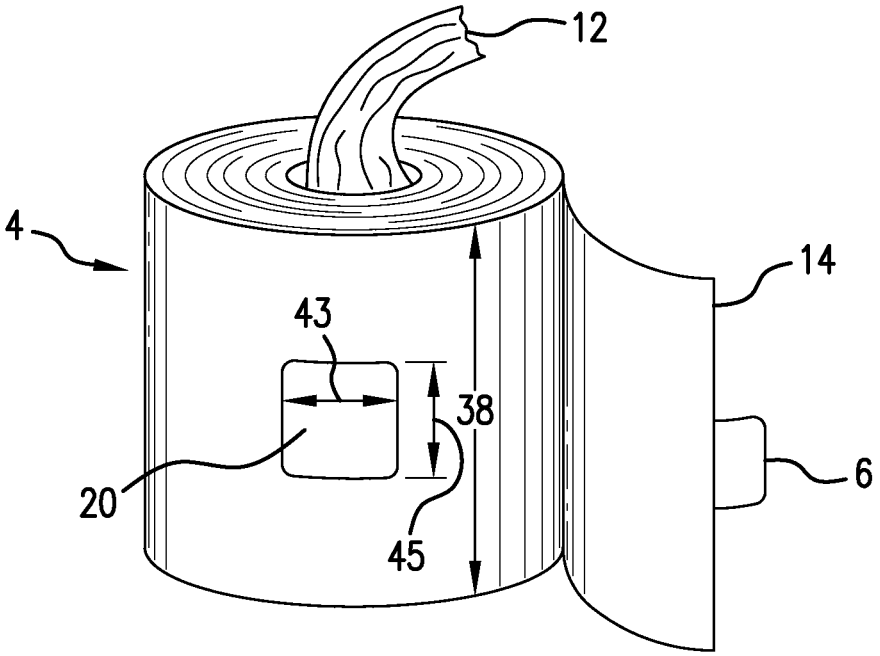
Figure 2C:
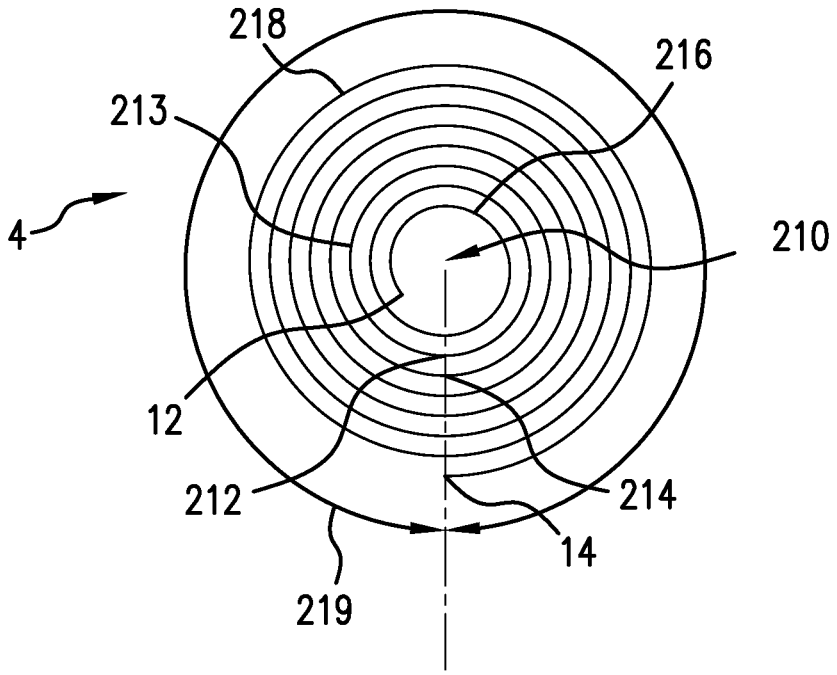
FIG. 2C is an illustrative view of the supply unit.

The supply units comprise of paper stock in a high-density configuration having a first longitudinal end and a second longitudinal end. Preferably, the supply units are coreless rolls 4 having a hollow core 210 that are substantially cylindrical to form a cylindrical roll. The roll 4 has a first and second longitudinal ends, where the first longitudinal end is the inner end 12 of the roll and the second longitudinal end is the outer end 14 of the roll extending therefrom and opposite the outer end 14. As shown in FIG. 2C, the rolls are formed by winding a ribbon of sheet material, preferably to leave a hollow center 210, rolling the material up into a roll with multiple layers. Each layer in the supply roll is a longitudinal length of the ribbon of sheet material that extends about a single revolution 219 in the roll, and about layers that are internal with respect thereto. The sheet of material may be made of a single ply or multiple plies of material. Where multi-ply material is used, a layer can include multiple plies.

Each layer includes inner and outer layer ends 212, 214, as shown in FIG. 2C. In the exemplary roll illustrated in FIG. 2C, the layer ends 212, 214 are disposed a same circumferential position on the roll. The outer end 214 of one layer continuous and contiguous with the inner end 212 of the next outer layer, and inner end 212 of one layer continuous and contiguous with the outer end 214 of the next inner layer. For example, the circular line 219 shown in FIG. 2C depicts an exemplary illustration of a single layer 213 having an inner end 212 and an outer end 214. The outermost layer 218 of the roll in the embodiment shown has the outer surface of the roll.

The axial height 38 (shown in FIG. 2B) of the rolls is preferably about at least 5". Typically, the axial height 38 of the roll is about is about 12" to 48". The outer diameter 39 (shown in FIG. 6A) of the rolls is preferably about at least 5". The diameter 39 of the rolls is preferably about up to 24". More preferably, the diameter 39 is about 11" to 13". The inner diameter 41 (shown in FIG. 6B) of the center of the roll 4 is typically about at least 2" or at least 3". The diameter 41 of the center of the roll is typically about up to 8", more preferably up to about 6" or 4". Other suitable dimensions of the supply rolls can be used. Further, preferably each roll weighs about 20 to 60 pounds. In one example embodiment of the rolls, the outer diameter 39 of the roll is about between 11" to 12¼", and the inner diameter 41 is about 3" to 6". Additionally, in this example embodiment, the each roll weighs about 30 to 45 pounds. Larger or smaller rolls can be used in other embodiments.

Alternative embodiments of the roll can be provided in different shapes, such as flattened rolls with oval, square, rectangular, triangular, or other regular or irregular cross-sections. In addition, it is appreciated that in other embodiments, supply units can be stacks of papers, tractor feed, fan-folded source, a wind, or other similar form. It is also appreciated that other types of material can be used, such as pulp-based virgin and recycled papers, newsprint, cellulose and starch compositions, and poly or synthetic material, of suitable thickness, weight, and dimensions.

Preferably, an adhesive strip, such as a sticker 6, can be provided for daisy chaining multiple rolls 4 together, which will be furthered described in FIG. 4 below. The sticker 6 has a connecting member 16 and a base member 18, which are longitudinally adjacent to each other, as well as a release layer 20. Preferably the sticker 6 comprises both the connecting 16 and base member 18; however, the sticker 6 may comprise of only the connecting member 16 or only the base member 18 disposed at the end of the outer end 14 or lined on the bottom end of the outer end 14 such that the adhesive faces the inward or interior layers of the roll 4. The connecting member 16 and base member 18 can be sufficiently large enough to adhere the outer end 14 of a preceding roll 4 to the inner end 12 of a subsequent roll 4 and pull the outer end 14 of a subsequently roll 4 into the converting station 102 after the preceding roll 4 is depleted.

Figure 3:
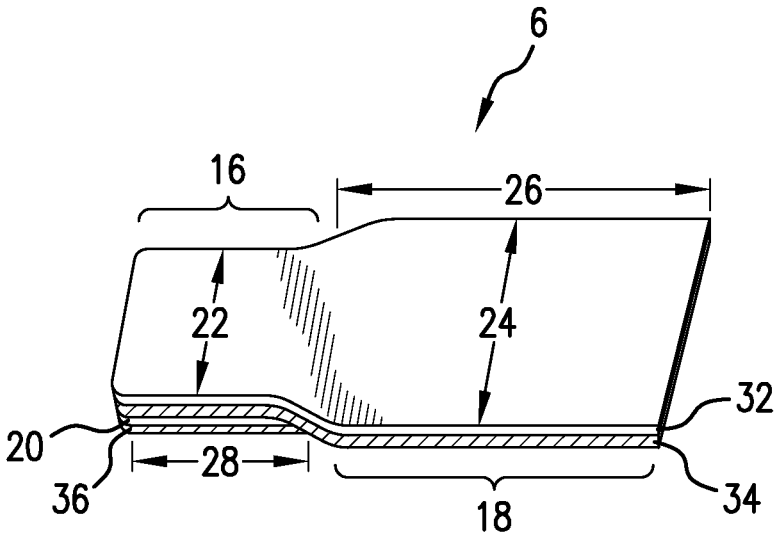
FIG. 3 is a front perspective view of another embodiment of the sticker.

As shown in embodiment of FIG. 3, the connecting member 16 and base member 18 can comprise a plurality of layers. For example, the first layer 32 can be a face stock or label that can be configured to receive writing, such as from a printer, pen, pencil, or marker. In the preferred embodiment, the face stock is made from a synthetic poly-material that is moisture resistant, thermal transfer receptive, and flexible and strong enough to provide prevent tearing while fed through the converting station 102. It is also appreciated that other types of material can be used, such as pulp-based virgin and recycled papers, newsprint, cellulose and starch compositions, poly or synthetic material, or other similar materials of suitable thickness, weight, and dimensions. The second layer is an adhesive layer 34 that has an adhesive lining, where the adhesive layer 34 is sufficiently strong enough to bond with the longitudinal ends 12,14. Preferably the adhesive is an emulsive pressure-sensitive adhesive such as acrylic, but other suitable adhesive can be used, i.e. rubber, tape, glue, and other suitable adhesives. The adhesive lining on the adhesive layer 34 can be substantially the same size as the face stock or label 32, or can be smaller than the face stock or label 32. The adhesive lining 34 may be of other shapes and configurations as long as it sufficiently strong enough to bond with the inner 12 and outer ends 14.

The sticker 6 can further comprise a grasping portion disposed at the end of the connecting member 16, but not secured to the roll 4. The grasping portion preferably has no adhesive quality and facilitates releasing the connecting member 16 from the release layer 20. Alternatively, the grasping portion can be created by adding an additional layer to the adhesive layer 34 thereby preventing that portion of the adhesive 34 from bonding onto the release layer 20.

In the preferred embodiment, multiple rolls 4 are daisy chained together using the sticker 6 to allow for an uninterrupted feeding of the material to the converting station 102. The other end 14 of each of the rolls 4 adhere to the inner end 12 of the roll 4 disposed directly thereunder at a connecting portion 42 via the sticker 6 (with the exception of the bottom-most roll because no roll is disposed directly thereunder) to form a daisy chain of rolls 4. The inner end 12 of the upper-most roll is pulled axially from the center of the roll in an upward direction 40 to be fed into the converting station 102.

Figure 4:
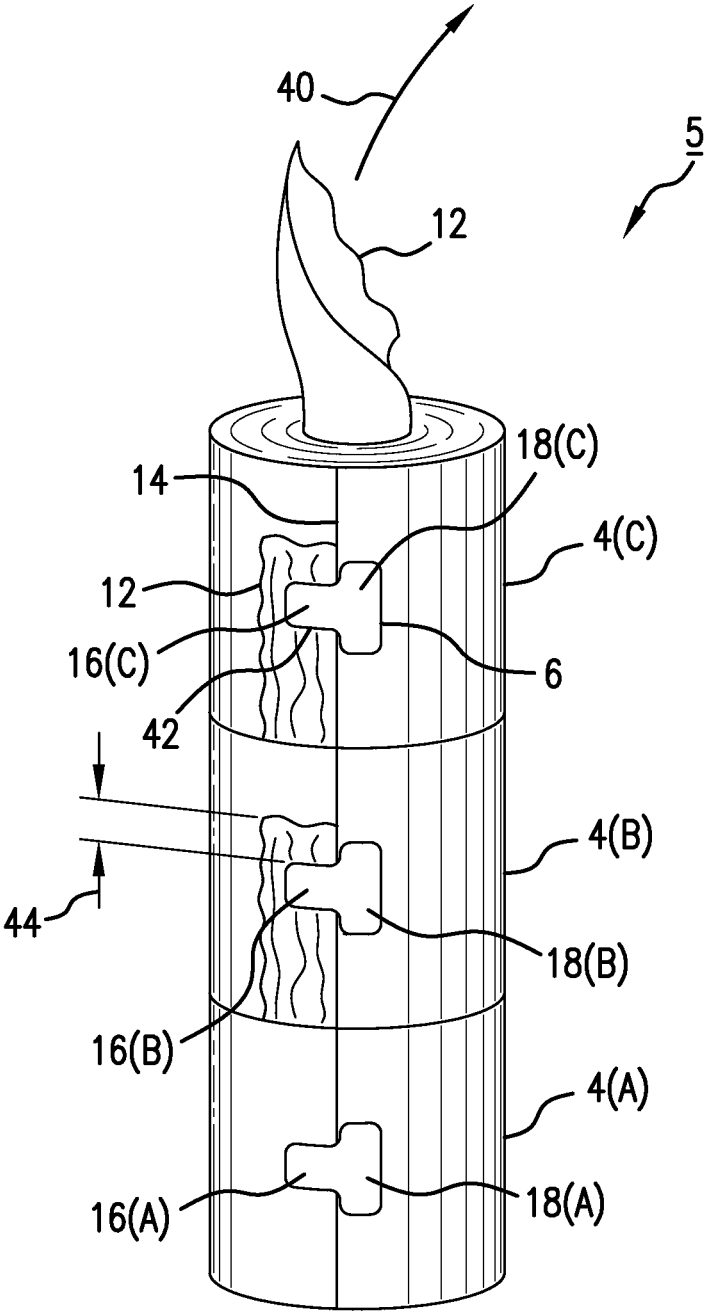
FIG. 4 depicts an exemplary embodiment of daisy chained supply units used with the system of FIG. 1.

In the embodiment shown in FIG. 4, three rolls 4(A), 4(B), and 4(C) are coaxially arranged and daisy chained, such as in a vertical stack of rolls 5. The base member 18(C) of the sticker 6 is adhered to the outer end 14 of the upper roll 4(C) and the connecting member 16(C) is connected to the connecting portion 42 of the inner end 12 of the middle roll 4(B). Similarly, another base member 18(B) is adhered to the outer end 14 of the middle roll 4(B) and another connecting member 16(B) is connected to the connecting portion 42 of the inner end 12 of a lower roll 4(A). In embodiments with more than three rolls, the lower roll 4(A) can be similarly be connected to another roll directly below it, and so on. Thus, creating a link between the upper roll 4(C), middle roll 4(B), lower roll 4(A), and so on. While FIG. 4 references three rolls, it is appreciated that an infinite number of rolls may be chained together to create an uninterrupted stream of sheet material.

Once the rolls 4 are daisy chained together, the inner end 12 of the upper-most roll 4 (i.e. upper roll 4(C)) in the stack of rolls 5 is fed into the converting station 102. During operation of the system 10, once the upper-most roll 4 (i.e. upper roll 4(C)) is consumed by the converting station 102, the converting station 102 automatically begins feeding from the inner end 12 of the lower roll disposed directly thereunder (i.e., middle roll 4(B)) and similarly, after that roll (i.e., middle roll 4(B)) has been consumed, the converting station 102 automatically begins feeding from the inner end 12 of the lower roll disposed directly thereunder (i.e., lower roll 4(A)) and so on until each roll 4 is consumed. The outer layer 218 is the last layer of the roll 4 to be pulled into the converting station 102.

The base member 18 or sticker 6 is preferably positioned in the center or middle of the outer end 14 to help distribute stresses more evenly between the ends of two attached rolls (i.e. the outer end 14 of the upper roll attached to the inner end 12 of the lower roll). In other embodiments, the base member 18 or sticker 6 can be positioned at various positions on the outer end 14, but not necessarily in the center or middle of the outer end 14. The distance 44 at which the sticker 6 is placed on the connecting portion 42 of the inner end 12 may be right or close to the end of the inner end 12, or more preferably the distance 44 is about 1" to 4" from the end of the inner end 12.

Preferably, the outer end 14 of the upper roll (i.e., upper roll 4(C) or 4(B)) can overlap the inner end 12 of the lower (i.e., lower roll 4(B) or 4(A)) when the sticker 6 is attached. Alternatively, the outer end 14 of the upper roll (i.e., upper roll 4(C) or 4(B)) can be disposed adjacent to the inner end 12 of the bottom roll (i.e., lower roll 4(B) or 4(A)) when the sticker 6 is attached.

The sticker 6 is preferably initially attached to the outer end 14 of the roll 4 to facilitate easy transportation of the roll 4. It is appreciated, however, that in other embodiments, the sticker 6 can be initially attached to the inner end 12 of the roll, and subsequently daisy chained to another roll.

Figure 5A:
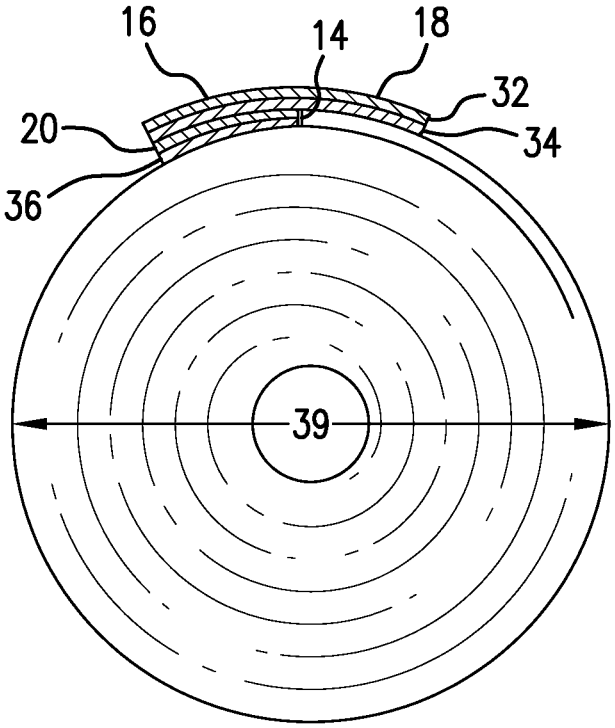
FIGS. 5A and 5B depict a bottom view of an embodiment of a dunnage material supply unit with the sticker of FIG. 3 adhered thereto.
Figure 5B:
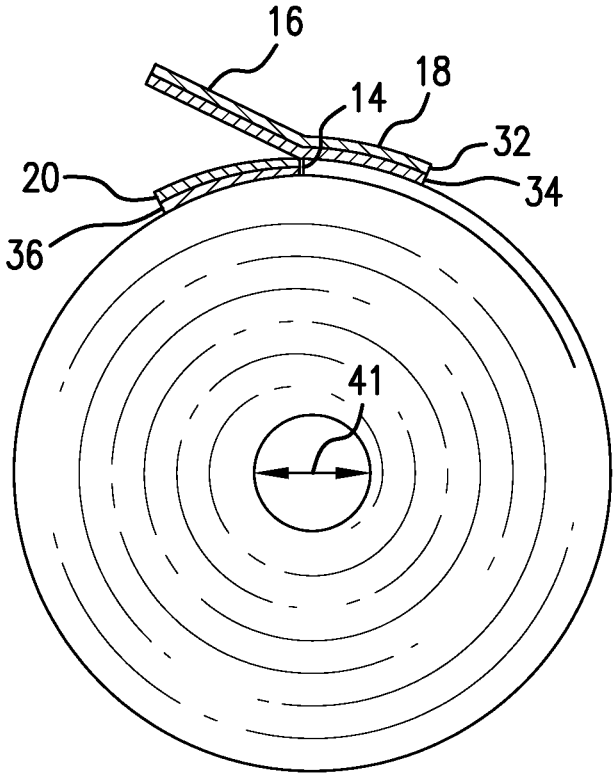

Preferably, the rolls 4 are coaxially arranged in an end-to-end manner, such as in a vertical stack of rolls 5, or otherwise arranged in an end-to-end manner. By daisy chaining the rolls together and arranging them in a vertical end-to-end manner, the rolls 4 are aligned radially around a vertical axis. Such arrangement allows the daisy chained rolls to be pulled into the converting station 102 with less resistance. A similar arrangement could also be provided with the rolls 4 arranged in a horizontal end-to-end manner. The rolls 4 can be oriented such the inner end 12 of the top unit is fed into the converting station 102 and has a counter clockwise spiraling coil that is fed into the converting station 102 as shown in FIGS. 1 and 5. Alternatively, the rolls 4 may be oriented such that the inner end 12 of the top unit has a clockwise spiraling coil. Further still, the inner end 12 of the rolls 4 may be oriented without a coil, but folded, crumpled, or other similar fashion.

In operation, a user stores the rolls 4 by adhering the entire sticker 6 onto a roll 4 such that the base member 18, shown in FIG. 6A, is adhered to the second longitudinal end 32 of the roll (illustrated as a roll in FIG. 6A for example purpose) and the connecting member 16 is adhered to the outward layer of the unit or roll adjacent to the outer end 14 by the second adhesive layer 36. To chain each roll together, the user releases or lifts one end of the connecting member 16 off an upper roll, as depicted in FIG. 6B. The first adhesive layer 34 becomes released from the release layer 20, which allows the connecting portion 42 of an inner end 12 of a lower roll to be adhered to the connecting member 16, and thus chained to the outer end 14 of the upper roll. In configurations where the sticker 6 comprises a grasping portion, the user can lift the grasping portion to release the connecting member 16 from the release layer 20.

In addition to daisy chaining multiple rolls 4 together, the sticker 6 can be used to facilitate packaging and transportation of the rolls 4. As shown in FIG. 2, the base member 18 of the sticker 6 is adhered to the outer end 14 and the connecting member 16 is adhered to the release layer 20 such that the outer end 14 is adhered to the outer layer of the roll 4. Thus, allowing for the rolls 4 to be configured for easy packaging and transporting of the rolls 4. While the sticker 6 described herein is shown, it is appreciated that in other embodiments, the rolls 4 can be daisy chained together using other suitable means.

The preferred transverse width of the material being fed through the converting station 102 is about at least 1", and more preferably about at least 4". The preferred transverse width of the material being fed through the converting station 102 is about at most 30", and more preferably about at most 5".

Preferably, the daisy chained stack of rolls 5 are placed within a supply handling assembly, such as a stabilizer assembly 51. The stabilizer assembly 51 can include multiple stabilizer units 52 that are aligned coaxially along a common spine 60 to form a column of stabilizer units 52 such that the stabilizer assembly 51 can hold a stack of rolls 5, of that are disposed in another suitable, non-aligned arrangement. Preferably, each stabilizer unit 52 is mounted independently to the common spine 60. The stabilizer assembly 51 can further include a base portion 298 adjacent the bottom-most stabilizer unit 52 disposed on the common spine 60 in which the bottom-most roll 4 in the stack of rolls 5 can rest thereon. Alternatively, the stabilizer units can have separate supports or depend from each other.

Preferably, the axial height 38 of each roll 4 (shown in FIG. 2B) is less than the axial height 240 of each stabilizer unit 52 (shown in FIG. 8), and preferably near or less than half of the stabilizer unit axial height 240. Thus, each stabilizer unit 52 can hold multiple rolls 4. In alternative embodiments, each stabilizer unit 52 can have greater heights, although it is preferred that the total height of the stabilizer 51 be selected so that the top is below eye level of an operator, with the bottom near the floor where the operator stands, although other arrangements are foreseen. In one embodiment, each stabilizer unit 52 has an axial height 240 that is at least about 6" up to about 70". Most preferably, each stabilizer unit 52 is about 20-40" in axial height 240.

In the preferred embodiment shown in FIG. 1, each stabilizer unit 52 is configured to hold one or two rolls 4. Preferably, a roll 4 can span across two stabilizer units 52 so that a portion of the roll 4 is stabilized cooperatively between two stabilizer units 52. For example, as shown in FIG. 1, the lower-most roll 4(A) rests upon the base portion 298 and is also positioned within stabilizer unit 52(A). The lower middle roll 4(B) stacked on and daisy chained to the lower-most roll 4(A) and, in the embodiment shown, spans between the stabilizer unit 52(A) and stabilizer unit 52(B), which is aligned directly above stabilizer unit 52(A). It is appreciated, however, that depending on the axial height 38 of the roll 4 and the axial height 240 of each stabilizer unit 52, a roll 4 may not necessarily span across multiple stabilizer units 52. For example, as shown in the embodiment in FIG. 1, an upper middle roll 4(C) is stacked on and daisy chained to the lower middle roll 4(B), but the upper middle roll 4(C) is fully contained within the stabilizer unit 52(B) without spanning across a second stabilizer unit 52. As illustrated in FIG. 1, the inner end 12 of the top-most roll (i.e., roll 4(D) shown) is fed into the converting station 102. While FIG. 1 only depicts two stabilizer units 52 and four rolls 4, it is appreciated that the stabilizer assembly 51 can comprise of more than or less than two stabilizers aligned on the common spine 60 and more or less than four rolls 4 in a stack arrangement. Alternatively, the stabilizer assembly 51 can comprise of a single stabilizer unit 52 with the rolls 4 stacked and daisy chained within the single stabilizer unit 52.

Preferably, each stabilizer unit 52 presses inwardly against the roll 4, preferably sufficiently gently to hold the shape of the outer layer 218 or outer few layers of one or more of the rolls 4 when the rest of the layers interior thereto have been depleted. As the inner end 14 of the roll 4 is continually fed into the converting station 102, the rolls 4 have a tendency to collapse on itself when only a few layers are remaining in the roll 4. As a result, and because the rolls 4 are fed to the converting machine from its center, the collapsed remaining layers or remainder or the roll 4 form big wads or chunks of the roll 4 that can be pulled up into the converting station 102 causing jams in the converting station 102 or causes the converting station 102 to disengage and turn off. The stabilizing units 52 disclosed gently presses inwardly against the surface of the roll 4 to prevent the roll from collapsing and generally maintain the roll's 4 shape. Additionally, the stabilizer unit 52 can support the roll 4 within the stabilizer unit 52 as the roll 4 is being depleted. The stabilizer units 52 are particularly desirable when rolls 4 are daisy chained together because a continuous uninterrupted stream of material 19 can be fed into the converting station 102 without the station 102 continuously jamming after each roll 4 in the daisy chain is depleted. It is noted that the inward pressure of the stabilizer unit 52 sufficiently stabilizes the rolls 4 so that the roll still maintains axial alignment within the stack of rolls 5 for the inner layers to be pulled from the center of the roll 4, but the stabilizer unit 52 does not cause significant deformation of the roll 4.

In addition, because the stabilizer units 52 are preferably made from a flexible, and resilient material, the stabilizer unit 52 can hold rolls 4 within a stack of rolls 5, where each roll 4 varies in size and basis weight within the stack 5. For example, the roll diameter 39 in a stack may vary up to ½ inch between each roll 4 within a stack arrangement, and the basis weight may vary between about 30

Figure 7:
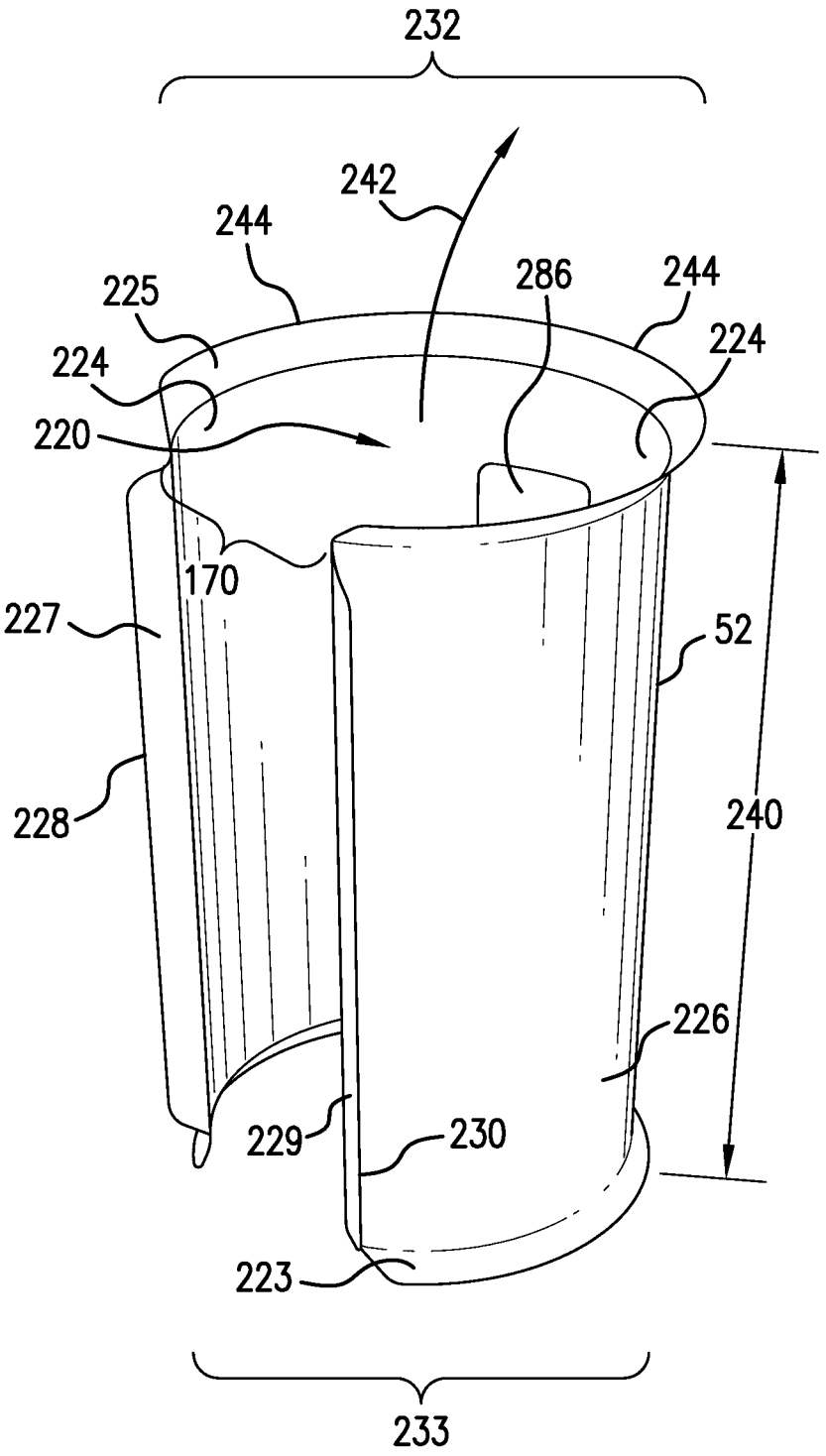
FIG. 7 is a perspective view of a stabilizer unit of FIG. 1.

In the preferred embodiment of the stabilizer unit 52 shown in FIG. 7, the stabilizer 51, and preferably each stabilizer unit 52, defines a roll-receiving space 220 in its interior for receiving the stack of rolls 5. In the embodiment shown, the stabilizer units 52 cooperatively define the overall receiving space 220. The roll-receiving space 220 is preferably tubular surface 222 and can have a substantially circular cross-section for receiving cylindrical rolls; but it is appreciated that in other embodiments, the tubular surface 222 can have other cross-sectional shapes, such as a square, rectangular, triangular, or other regular or irregular shapes.

The stabilizer unit 52 of this embodiment comprises a panel, such as a wall 226 of flexible material or a tubular wall of flexible material, which is preferably naturally biased inward to press against the rolls 4. The natural inward bias of the wall 226 provides sufficient force against the rolls 4 to keep the rolls 4 from collapsing when a few layers are left in each roll 4. Preferably, the wall 226 is a thin and curved. The wall 266 is preferably made of a thermoplastic material, such as acrylonitrile butadiene styrene, which provides enough flexibility to allow users to separate the wall 226 during loading of the rolls 4. In other embodiments, however, the wall 226 can be made of a high impact polystyrene, high-density polyethylene, other types of plastic or thermoplastic material, cardboard, metal, or other similar material.

Preferably, the wall 226 includes two perimeter ends 228,230 that are disposed at opposite lateral ends of the wall 226 to define an opening 120 therebetween. The wall 226 can further include wall portions 244. In the preferred embodiment, the wall 226 is sufficiently flexible to allow a user to separate the perimeter ends 228, 230 at the opening 120 for loading the rolls 4 into the roll-receiving space 220. The opening 120 also allows users to, for example, identify the supply units and/or detailed loading and operating instructions written, for example, on the sticker 6. In alternative embodiments, the opening 120 can further include a clear material, such as plastic or glass, at the opening 120 to view identification material on the supply units 4.

Preferably, the perimeter ends 228, 230 have flared potions 227, 229 that facilitate the user with separating the perimeter ends 228, 230 during loading. The perimeters ends 228, 230 of the wall 226 are also preferably biased inwardly such that when a roll 4 is disposed in the roll-receiving space 220, the perimeter ends 228, 230 are biased against the roll 4. Further, the perimeter ends 228, 230 are preferably sufficiently biased such that the outer surfaces of the rolls 4 are gently compressed to prevent the rolls 4 from collapsing as the interior layers are fed into the converting station 102 so that large portions or chunks of the rolls 4 are not fed into the converting station 102 without unwinding first. It is appreciated that in other configurations, the perimeter ends 228, 230 may not have flared portions 228, 229.

Figure 9:
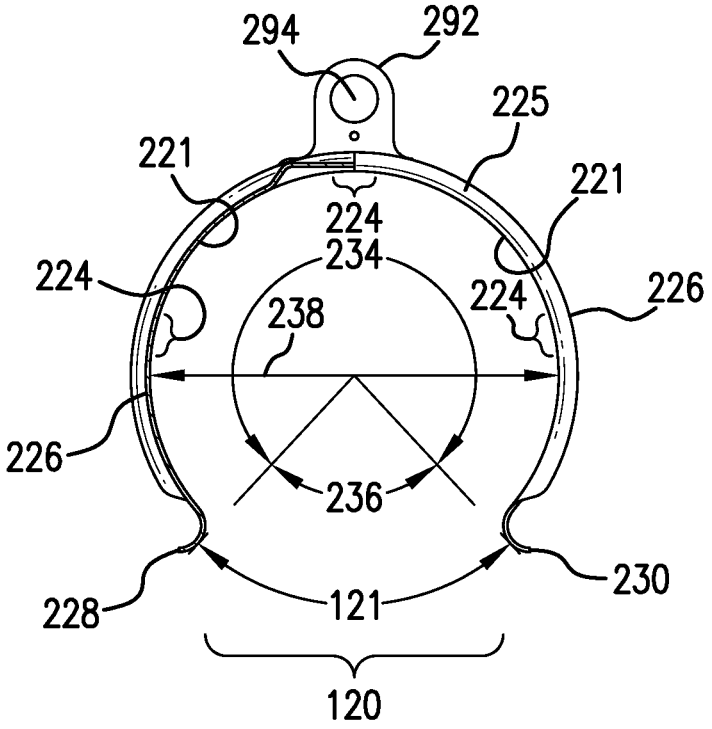
FIG. 9 is the front view of an exemplary embodiment of the stabilizer unit of FIG. 1.

Each stabilizer unit 52, in the preferred embodiment, further comprises an interior facing support surface 224 that is biased toward the outer surface of the roll that is disposed about the phantom surface of the tubular space 220, or when the rolls 4 are received therein, about the outer surface of the rolls 4. The interior facing support surface 224 are the points or contact locations in which the stabilizer unit 52 contacts the outer surface of the rolls 4 to stabilize the rolls 4. Preferably, the interior support surface 224 is radially biased to a circumference smaller than the circumference of the roll 4 to stabilize the outer surface of the rolls 4. As shown in the embodiment of FIG. 9, the interior facing support surface 224 can be disposed at a plurality of locations along the inner surface 221 of the wall 226. Preferably, the interior facing support surface 224 is sufficiently disposed along the inner surface 221 of the wall 226 to sufficiently stabilize an outer layer of the roll when the remainder of the roll 4 has been extracted from the center of the roll and fed into the converting station 102. Thus, the interior facing support surface 224 stabilizes the outer surface of the rolls 4 at a plurality of points spaced around the circumference of the roll 4. For example, as illustrated in FIG. 9, the interior facing support surface 224 can have three contact locations spaced around the circumferential coverage angle 234 at a predetermined distance. The interior facing support surface 224 contacts the outer surface of the rolls 4 in at least two locations spaced at a predetermined distance, more preferably the interior facing support surface 224 contacts the outer surface of the rolls 4 in at least three locations, and most preferably the interior facing support surface 224 extensively contacts the outer surface of the rolls 4.

The interior support surface 224 defines an upper axial opening 232 disposed at the top portion of each stabilizer unit 52. The inner end 12 of the roll 4 drawn from the center of roll 4 exits the stabilizer unit 52 through the upper axial opening 232 along a discharge path 242. This allows the inner end 12 of the roll 4 to be drawn from the interior of the roll-receiving space 220 along a discharge path 242 and into the converting station 102.

In the preferred embodiment, the wall 226 also includes a flared portion 225 that is flared radially outward and disposed at the top portion of the stabilizer 52 near the upper axial opening 232. The flared portion allows for a user to easily load supply units into the stabilizer 52 without, for example, having to open the stabilizer 52 by separating the perimeter ends 228, 230.

Preferably, the interior support surface 224 further defines a lower axial opening 233 (as shown in FIG. 7) disposed at the lower portion of the stabilizer unit 52. The lower portion of the wall 226 can also include a flared portion 223 that is flared radially outward and disposed at the lower portion of the stabilizer unit 52 and near the lower axial opening 233.

Figure 8:
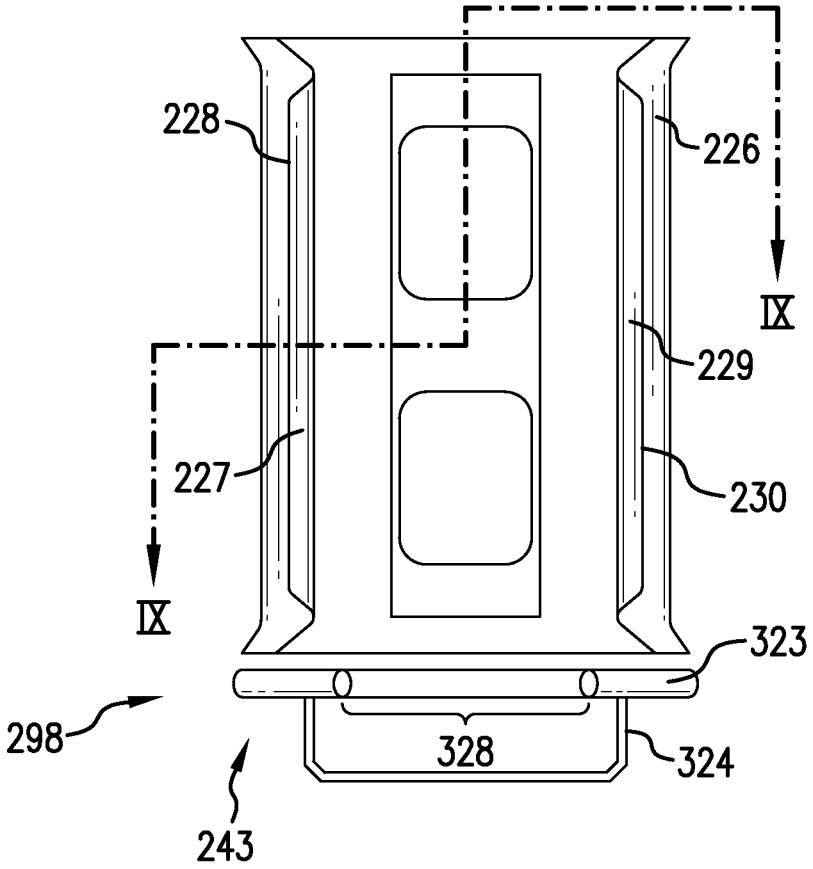
FIG. 8 is a top view and cross-sectional view of the stabilizer unit of FIG. 1.

FIG. 9 depicts the a cross-sectional and top view IX of the individual stabilizer unit 52 of FIG. 8, where the left hand side is a cross-sectional view of the middle portion of the stabilizer unit 52 and the right hand side is the top view of the stabilizer unit 52. As shown in FIG. 9, the wall 226 preferably has a substantially circular cross-section. In other configurations, the wall 226 can have other cross-sections such as a square, rectangle, triangle, or other regular or irregular shape. Preferably, the diameter 238 of the stabilizer unit 52 is about at least 5", and more preferably about at least 10". Preferably, the diameter 238 of the stabilizer unit 52 is about at most 14", and more preferably about at most 13". In the preferred embodiment, the stabilizer unit 52 has a relaxed diameter of 11", but can be expanded up to 12¼" for larger rolls and to facilitate loading. In some embodiments, the diameter 238 of the cross-section of the wall 226 can be less than the diameter 39 of the rolls 4. Because the wall 226 in this embodiment is made of a resilient, naturally biased material that has a diameter 238 of the stabilizer unit 52 that is smaller than the diameter 39 of the roll(s) 4 therein, the resiliency of the wall 226 can provide or contribute to the wall's 226 inward pressure against the rolls 4.

The stabilizer unit 52 further includes a circumferential coverage angle 234 as shown in FIG. 9. The circumferential coverage angle 234 defines the surface area in which the stabilizer unit 52 covers the rolls 4. The circumferential coverage angle 234 also defines a radial angle 236. The radial angle 236 further defines an arc length 121 which corresponds to the width of the opening 120 between the perimeter ends 228, 230. Preferably, the radial angle 236 of the circumferential coverage angle 234 is about at least 40° and more preferably about at least 60°. Preferably, the radial angle 236 of the circumferential coverage angle 234 is about up to 70° and more preferably is about up to 95°. For example, in one embodiment, wall 226 can be made of metal and have a diameter 238 of about 12" with a radial angle 236 of about 90°. In another example embodiment, the wall 226 can be made of plastic, and have a diameter 238 of about 11" with a radial angle 236 of about 60°. Preferably, the interior support structure 224 is biased against the roll about the cover angle 234 of about at least 40% of the circumference of the roll 4, and more preferably, about at least 60% of the circumference of the roll 4. Preferably, interior support structure 224 is biased against the roll about the cover angle 234 of about at most 100% of the circumference of the roll 4, and more preferably about at most 80% of the circumference of the roll 4.

Figure 10:
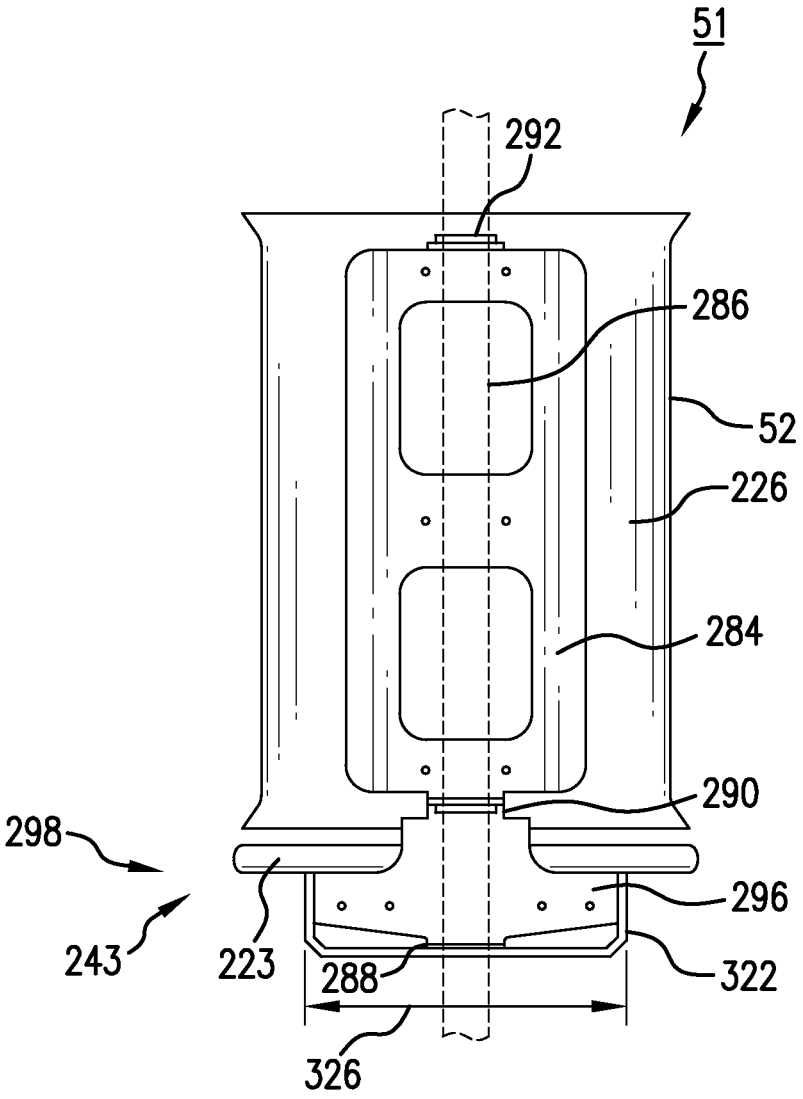
FIG. 10 is the back view of the exemplarily embodiment of the stabilizer of FIG. 1.
Figure 11:
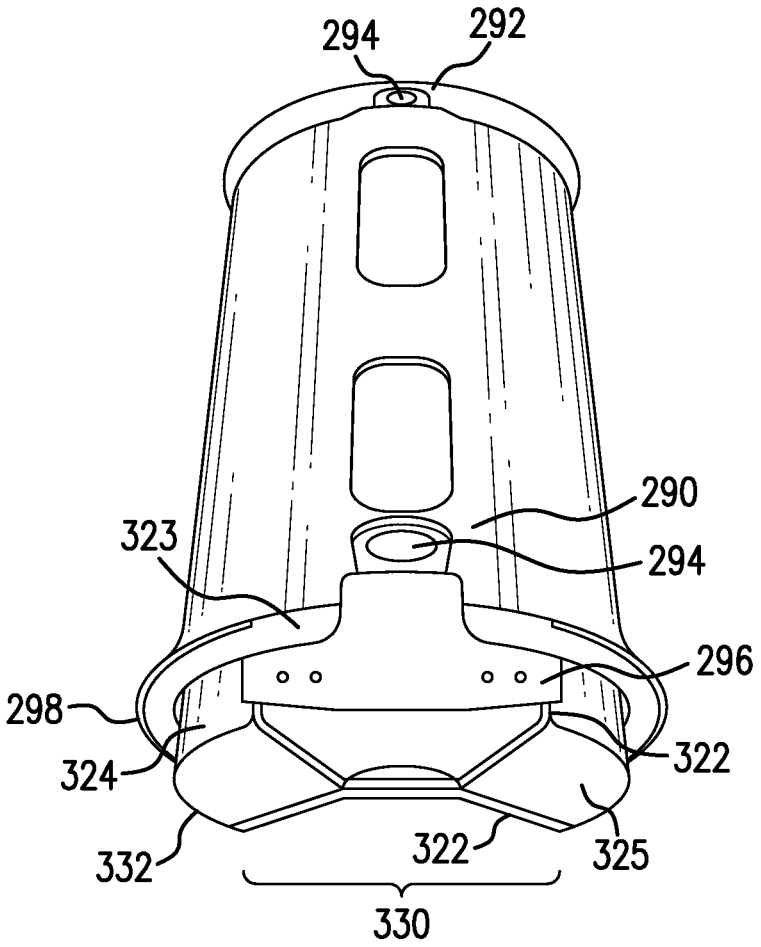
FIG. 11 is the bottom perspective of the exemplary embodiment of the stabilizer of FIG. 9.

The stabilizer unit 52 preferably includes a spine support, such as a mounting bracket 284, which is disposed opposite the opening 120 of the stabilizer 52 as shown in FIGS. 10 and 11. The mounting bracket 284 provides stability of the wall 226. The mounting bracket 284 is preferably made from steel, but other materials such as plastic, metal, or other similar materials can be used. Preferably, the mounting bracket 284 is preferably rigid enough to provide stability and create gentle inward pressure of the wall portions 244 against the rolls 4, but is also flexible enough to allow the wall portions 244 to be expanded and separated at the perimeter ends 228, 230 during loading.

In the embodiment shown, the mounting bracket 284 includes at least two openings 286 to allow users to view the rolls. In alternative configurations, the mounting bracket 284 can include more than two openings, less than two openings, or no openings.

The wall 226 of the stabilizer unit 52 can be constructed from a unitary piece of material. In some embodiments, however, the wall 226 of the stabilizer unit 52 can further comprise two or more wall portions that are adjoined together at the hinge by the mounting bracket 284. In other configurations, the mounting bracket 284 can act as a hinge between the two wall portions.

Figure 6:
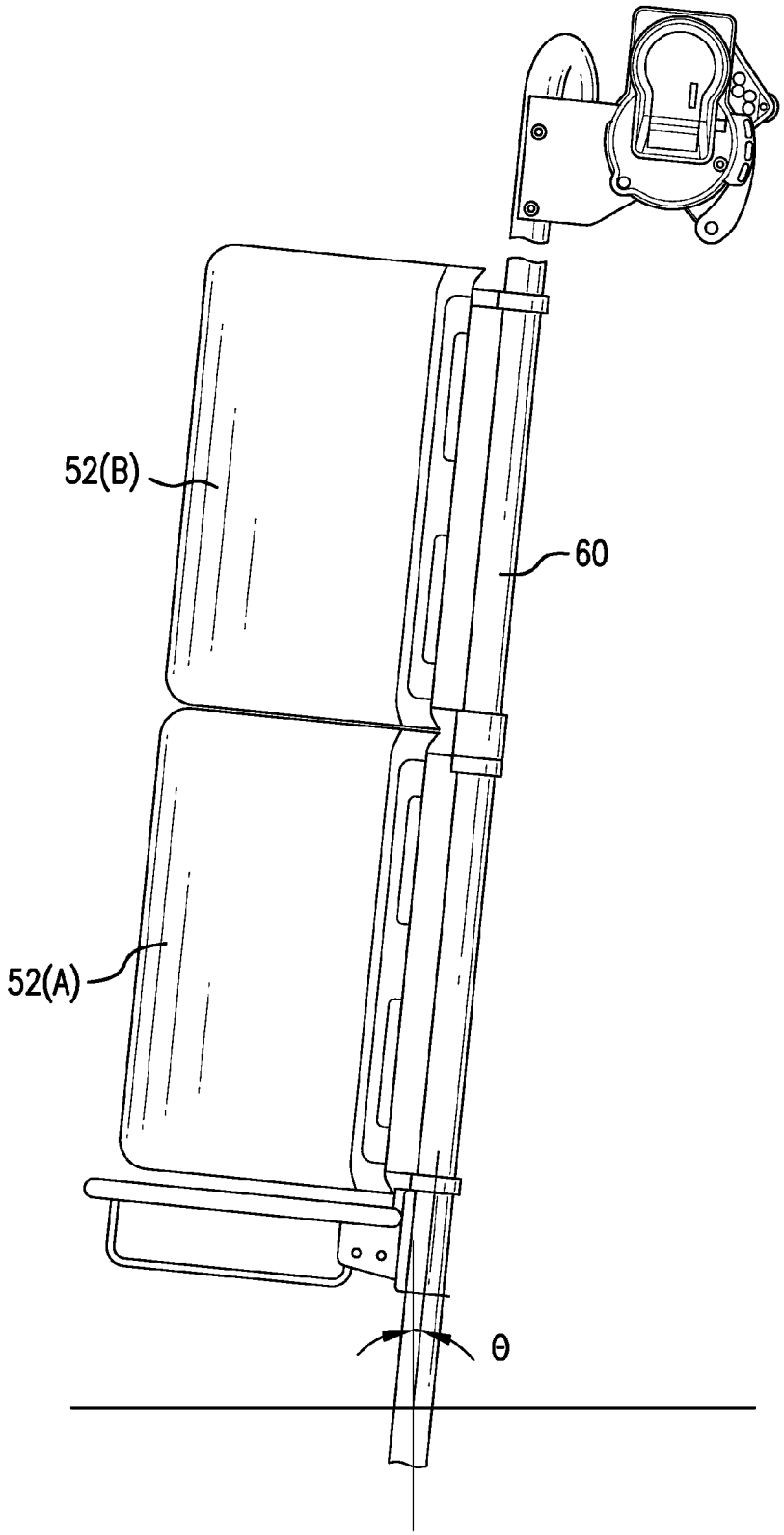
FIG. 6 depicts an exemplary embodiment of the stabilizer units of FIG. 1.

Additionally, each stabilizer unit 52 can be affixed to an elongated member, such as a spine 60, by the mounting bracket 284, as shown in FIG. 6. Preferably, the mounting bracket 284 can include mounting extension portions 290, 292 extending from the upper and lower portions of the mounting bracket 284. Each stabilizer unit 52 can be affixed by bolts, screws, or other fasteners. The mounting extension portions 290, 292 extend substantially perpendicularly from the surface of the mounting bracket 284. The mounting extension portions 290, 292 can include a hole 294 to allow the spine 60 to pass therethrough, and to allow for pivoting motion of the stabilizer 52 about the spine 60. In some embodiments, the stabilizer unit 52 can further comprise a locking mechanism to position the stabilizer unit 52 on the spine 60, and to prevent the stabilizer unit 52 from moving while rolls 4 are fed into the converting station 102. In yet other configurations, the stabilizer unit 52 can be removably connected to the spine 60.

Preferably, the spine 60 is oriented generally upright, or in some configurations, the spine 60 can be at an inclination with respect to the vertical plane. The spine 60 can be angled an angle θ with respect to a vertical plane. Preferably, the angle θ is about at least 3° to at most about 30°. More preferably, the angle θ is about 6°.

In the embodiment shown, the stabilizer assembly 52 includes a base support 298 disposed near the lower axial opening 233 of the bottom-most stabilizer unit 52. The base support 298 assists in supporting the rolls 4. Preferably the base support 298 is removable. In other embodiments, the base support 298 can be omitted altogether.

Preferably, the base support 298 is affixed to the stabilizer 52 by a support bracket 296, which is preferably affixed by bolts, screws, or other fasteners. In the preferred embodiment, the base support 298 includes a surrounding containment device 243. The surrounding containment device 243 can include a partial hoop structure 323 oriented horizontally for tangentially engaging the periphery of a roll 4 of sheet material. In alternative embodiments, a full hoop structure may be provided. The partial hoop structure 323 preferably has the same cross-sectional shape as the rolls 4, which in the preferred embodiment is cylindrical, for smoothly receiving the roll 4 of material into the base support 298.

In this preferred embodiment, the partial hoop structure 323 has a diameter 326 (as shown in FIG. 10) close in size to the diameter 39 of the rolls 4. Preferably, the diameter 326 is about at least 6", more preferably, the diameter 326 is about at least 8". Preferably, the diameter 326 is about at most 25" and, more preferably about at most 16". Further, the partial hoop structure 323 preferably includes an angle substantially similar to the circumferential coverage angle 234 of the tubular space 220. It is appreciated, however, that other cross-sections and angles can be provided.

The partial hoop structure 323 may define an opening 328 (as shown in FIG. 8), and the opening 328 can be arranged opposite the mounting bracket 284. The partial hoop structure 323 can pass substantially tangentially along the central portion of the support bracket 296 portion 314 of the support bracket 296, and can be fixedly secured thereto such as by welding, for example. Bolts, screws, or other fasteners may also be used. Where fasteners are used, countersunk or counter bored holes may be used to allow for a smooth interior finish on the hoop structure to avoid tearing, catching, or otherwise interfering with the outer surface of the roll of sheet material.

The base support 298 can further include a series of rods or wires 322 configured to extend down from the partial hoop structure 323, and across the bottom of the base support 298. The series of rods or wires 322 further support base walls 332. The base walls 332 include side portions 324 and a bottom portion 325. The side portions 324 extend from the partial hoop structure 323, and the bottom portion 325 extends across the bottom of the base support 298. Preferably, the shape of the base walls 324 is substantially similar to the structure created by the series of rods or wires 322. As shown in FIG. 11, the base walls 332 include a base opening 330 which is preferably aligned to the opening 328 of the partial hoop structure 323.

As shown in FIGS. 6 and 10, the base support 298 preferably includes a base support extension portion 288 that includes a hole similar to the mounting extension portions 290, 292 of the mounting bracket 284. The base support extension portion 288 allows the elongated member 60 to pass therethrough, and allows for the base support 298 to pivot about the elongated element 60 with respect to the stabilizer 52. In an alternative embodiment, the base support 298 can have two base support extension portions, where one is positioned at the upper portion of the support bracket 296 substantially near the lower mounting extension portion 290, and the second is positioned at the lower portion of the support bracket 296.

In another embodiment of the base support, the base support 298 can comprise of the series of rods and wires 322 without the base wall 332. In alternative embodiments, the partial hoop structure 322 of the base support 280 can be omitted. In yet other embodiments of the base support, the base opening 330 can be omitted such that the base wall 322 covers substantially the entire base support 298. In yet other embodiments, the base support 298 can comprise of a base plate without the partial hoop structure 322.

While the embodiments disclosed herein have the stabilizing unit 52 pressing against the roll 4, it is foreseen that in other embodiments, the stabilizing unit 52 can be made to effectively stabilizing against collapsing, where the shape of the stabilizing unit 52 matches the outer shape of the roll 4, or is larger than the roll 4 and doesn't provide compression.

To load each stabilizer unit 52, a user can either separate the stabilizer unit 52 at the opening 120 and insert the a roll, or load the roll through the upper axial opening 232. The user first loads the bottom-most roll 4(A) into the bottom-most stabilizer unit 52(A). If there is a base portion 298, the user can position the bottom-most roll 4(A) within the base portion 298 and in the bottom-most stabilizer unit 52(A). The user then loads the lower middle roll 4(B) within the bottom-most stabilizer unit 52(A) by either loading it through the upper axial opening 232 or by separating the stabilizer unit 52(A) at the opening 120. Once loaded, the user can daisy chain the lower roll 4(A) to the lower middle roll 4(B) as described above, and so on. Once all the rolls are loaded and daisy chained together, the inner end 12 of the upper most roll is fed into the converting station 102.

Figure 12:
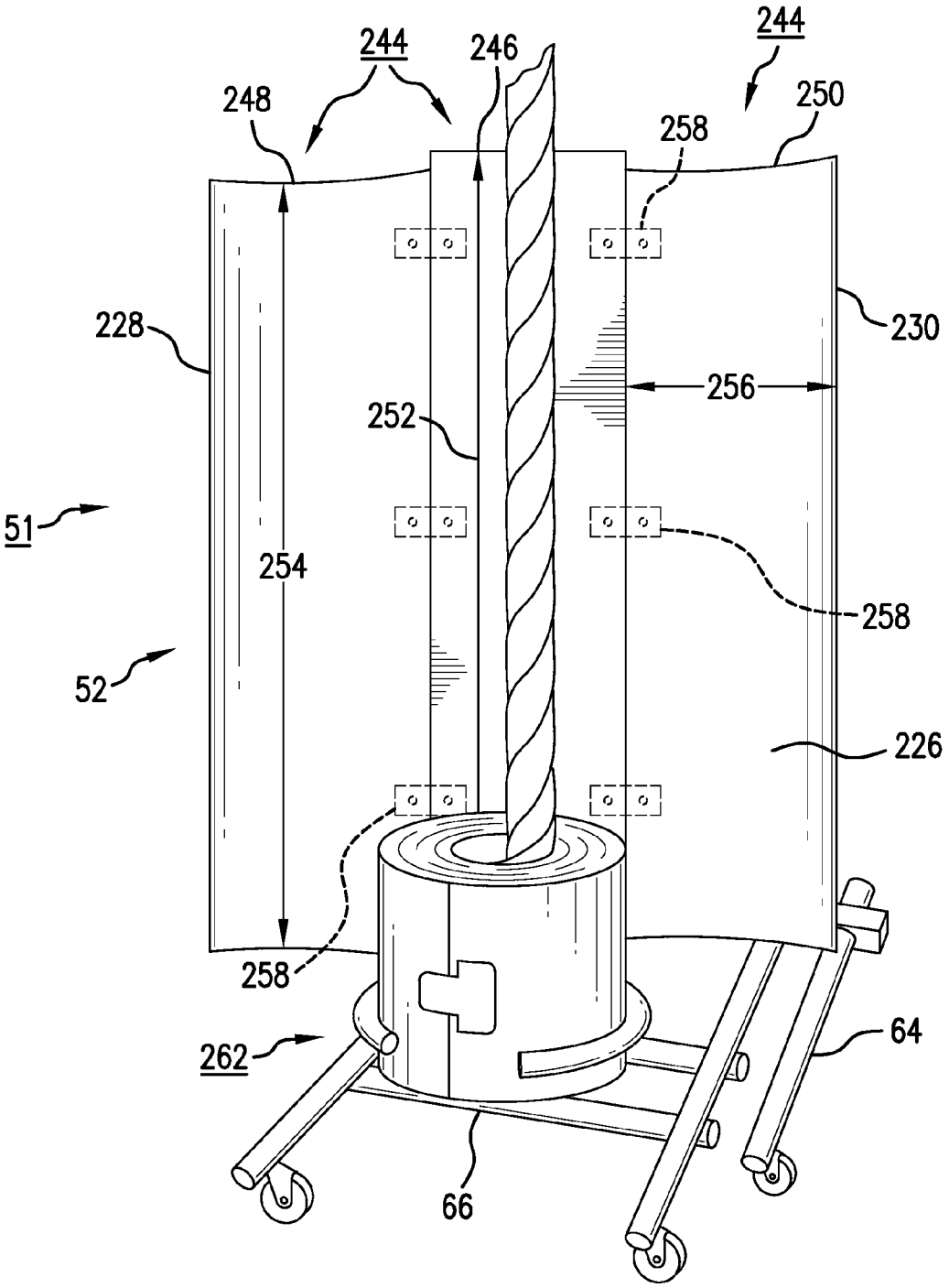
FIG. 12 is a front view of an exemplary embodiment of the stabilizer in accordance with the present disclosure.

FIG. 12 illustrates an alternative embodiment of the stabilizer unit 52. In this exemplary embodiment, the wall 226 comprises of at least three wall portions 244 adjoined together. The adjoined wall portions 244 cover the outer surface of the rolls 4, as shown in FIG. 12, and define two perimeter ends 228, 230 which further define the opening 120. It is, however, appreciated that similar to as described above, the wall portions 244 can extensively cover the outer surface of the rolls or cover only a portion of the rolls.

Continuing with the alternative embodiment shown in FIG. 12, the wall 226 can comprise of a middle wall 246, and a left 248 and right wall 250 that flanks either side of the middle wall 246. The middle wall 246, as shown in FIG. 12, can have a height 252 greater than the height 254 of the two side wall portions 248, 250. In other configurations, however, all of the wall portions 244 can be of equal height and longitudinal length 256. Further, in another embodiment, multiple stabilizer units can be stacked upon each other (not shown in FIG. 12) similarly to as shown and described in FIG. 1. The rolls 4 within the stacked stabilizers 52 are daisy chained together to form an uninterrupted chain of material. Alternatively and as shown in FIG. 12, a single stabilizer unit 52 configured to receive a stack of daisy chained rolls 4 can be used.

As shown in FIG. 12, the left and right walls 248,250 can be adjoined to the middle wall 246 by a hinge 258 to allow the wall portions 244 to move from an open to a closed position. In this exemplary embodiment, when the wall portions 244 are in the open configuration, the rolls 4 can be stacked or placed in the stabilizer 51. While in the closed position, the wall portions 244 press against the rolls 4 with sufficient inward force to maintain the structural the shape of the rolls 4, similarly to as described above. In the preferred embodiment, the hinge 258 can be spring-loaded such that it puts pressure on the rolls, and accounts for the change in the roll size as the layers of the roll is fed into the converting station 102.

In yet other embodiments of the stabilizer 51, or stabilizer units 52, the wall 226 can be press inwardly by magnets adhered at the perimeter ends 228, 230 where the magnets have sufficient attraction to inwardly press the perimeter ends 228, 230 toward the phantom tubular surface 222. In addition, alternative means of compressing the wall 226 can be used such as an elastic cord, an elastic strap, other configurations of magnetic force, positioning hinge, or slotted expandable material. In other embodiments, a latch can be used to hold the perimeter ends 228, 230 in a closed position, and compress the wall 226 or wall portions 244 against the rolls 4.

In an alternative embodiment, the stabilizer 51, or stabilizer units 52, can comprise a door at the opening 120 that includes a door hinge at one lateral side of the door that is adjoined to one of the perimeter ends 228, 230. The door can further include a latch, snap-fit, or other similar mechanical fastener on the opposite lateral side of the door hinge to allow the door to be easily attached and separable from the perimeter end opposite the door hinge. In the open configuration, the door is unlatched or open to facilitate loading the rolls 4 into the roll-receiving space 220. In the closed configuration, the door facilitates the inward compression of the wall 226 against the rolls 4. In one embodiment of the door, the door can have a longitudinal length slightly less than that of the opening 120, such that the when the door is latched or in the closed configuration, the door slightly pulls the perimeter ends 228, 230 together creating a slight inward force against the rolls 4.

Figure 13:
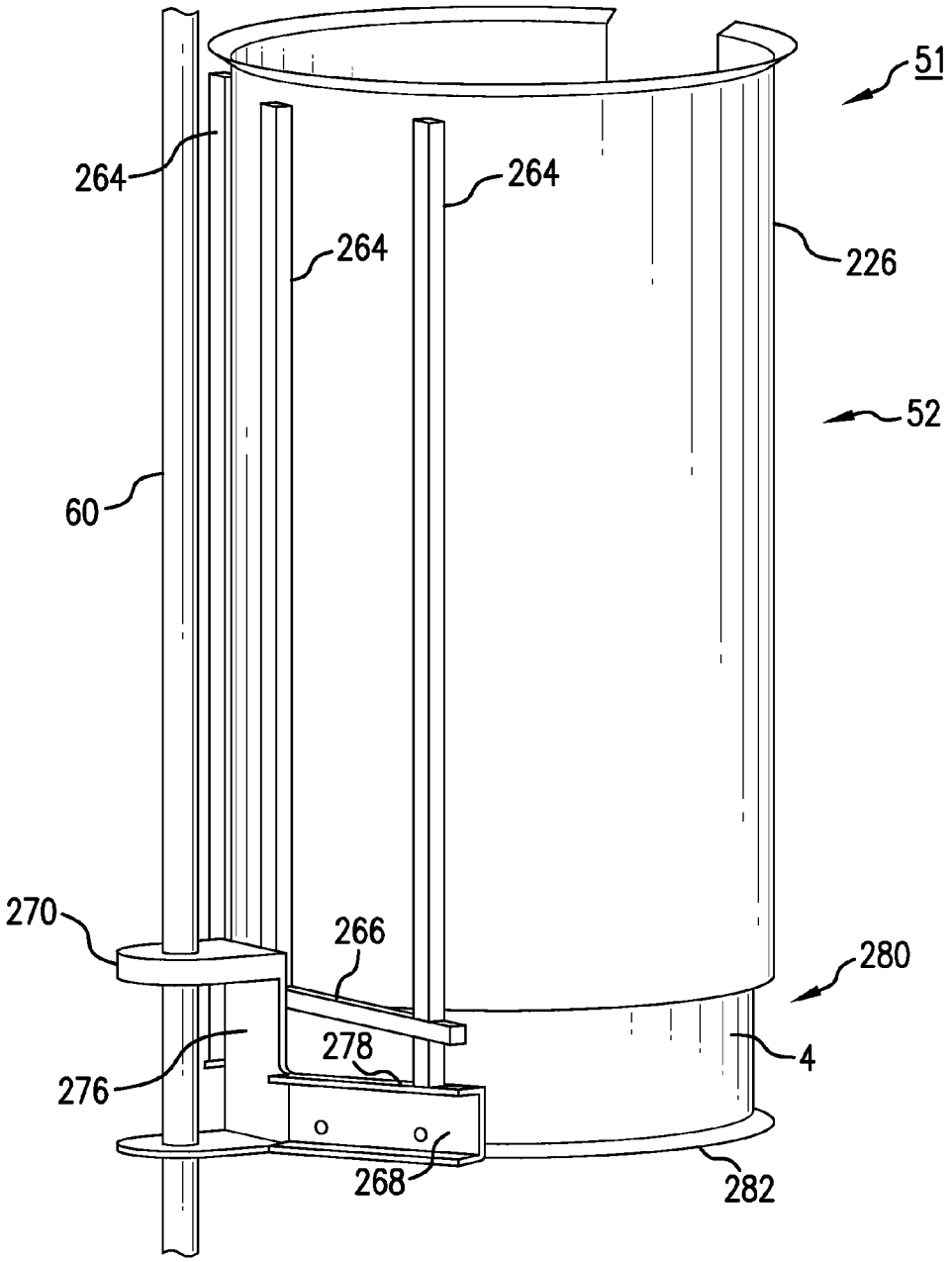
FIG. 13 is a back view of an another exemplary embodiment of the stabilizer in accordance with the present disclosure.

FIG. 13 depicts another embodiment of the stabilizer 51, or stabilizer units 52. In this exemplary embodiment, the stabilizer 51 includes a plurality of spines 264 disposed at a predetermined distance on the back portion of the stabilizer 51. While FIG. 13 shows three spines 264, it is appreciated that in some configurations more than three spines can be used or less than three spines can be used. The spines 264 can extend the height 254 of wall 226 to provide structural support to the stabilizer 52. In this exemplary embodiment, the spine 262 is affixed to a spine support bar 266 which is further affixed to a spine bracket 268. As shown in FIG. 13, the stabilizer bracket 270 can further comprise an L portion 278 in which the spine bracket 268 is affixed thereto, and the spine bracket 268 is affixed to the stabilizer bracket 270 by welding. Bolts, screws, or other fasteners can also be used.

Further, as shown in FIG. 13, the stabilizer unit 52 can be affixed to a spine 60 by a stabilizer bracket 270. The stabilizer 52 is affixed securely to the stabilizer bracket 270 by welding, for example. Bolts, screws, or other fasteners can also be used. The stabilizer bracket 270 can be adapted for sleevably engaging the spine 60 similar to the mounting bracket 284 described above. Other mounting methods can be used.

In another alternative embodiment, the stabilizer 51 or stabilizer unit 52 can be made more rigid to stabilize the shape of the rolls 4.

While the embodiments shown depict the stabilizer wall 226 being contiguous, it is appreciated that in other embodiments, the wall 226 can be made of other structures. For example, the wall 226 can be structured as longitudinal finger rails, having interior facing support surface 224, that press inwardly into the phantom surface of the tubular space 220 or against the rolls 4. In other embodiments, the wall 226 can be made from a single unitary piece of material. In yet other embodiments, the wall 226 can be comprised of support members collectively forming an interior facing support surface. The support members and interior support surfaces 224 can be arranged in a different configuration with varying heights and lengths so long as the arrangement of interior facing support surfaces 224 sufficiently support and compress the outer surface of each roll 4 to prevent the rolls 4 from collapsing as the interior layers of the roll 4 are depleted. For example, in one configuration, the stabilizer 52 can comprise of three separate support members, such as rods extending along the height of the stabilizer unit 52, where the support members, having interior facing support surfaces disposed evenly around the circumferential coverage angle 234. In a second example, the stabilizer can comprise of two separate support members, having an interior support surface, where the support members are positioned opposite each other and one support member has a larger surface area (and thus larger interior facing support surface) than the other.

As discussed above, in the preferred embodiment, the system 10 is configured to pull continuous stream or daisy chain of sheet material 19 from rolls 4 and into a converting station 102, where the converting station 102 converts the high-density material into a low-density material. The material can be converted by crumpling, folding, flattening, or other similar methods that convert high-density material to a low-density material. Further, it is appreciated that various structures of the converting station 102 can be used, such as those converting stations 102 disclosed in U.S. application Ser No. 61/537,021, U.S. Publication 2012/016172, U.S. Publication No. 2011/0052875, and U.S. Pat. No. 8,016,735.

Figure 14A:
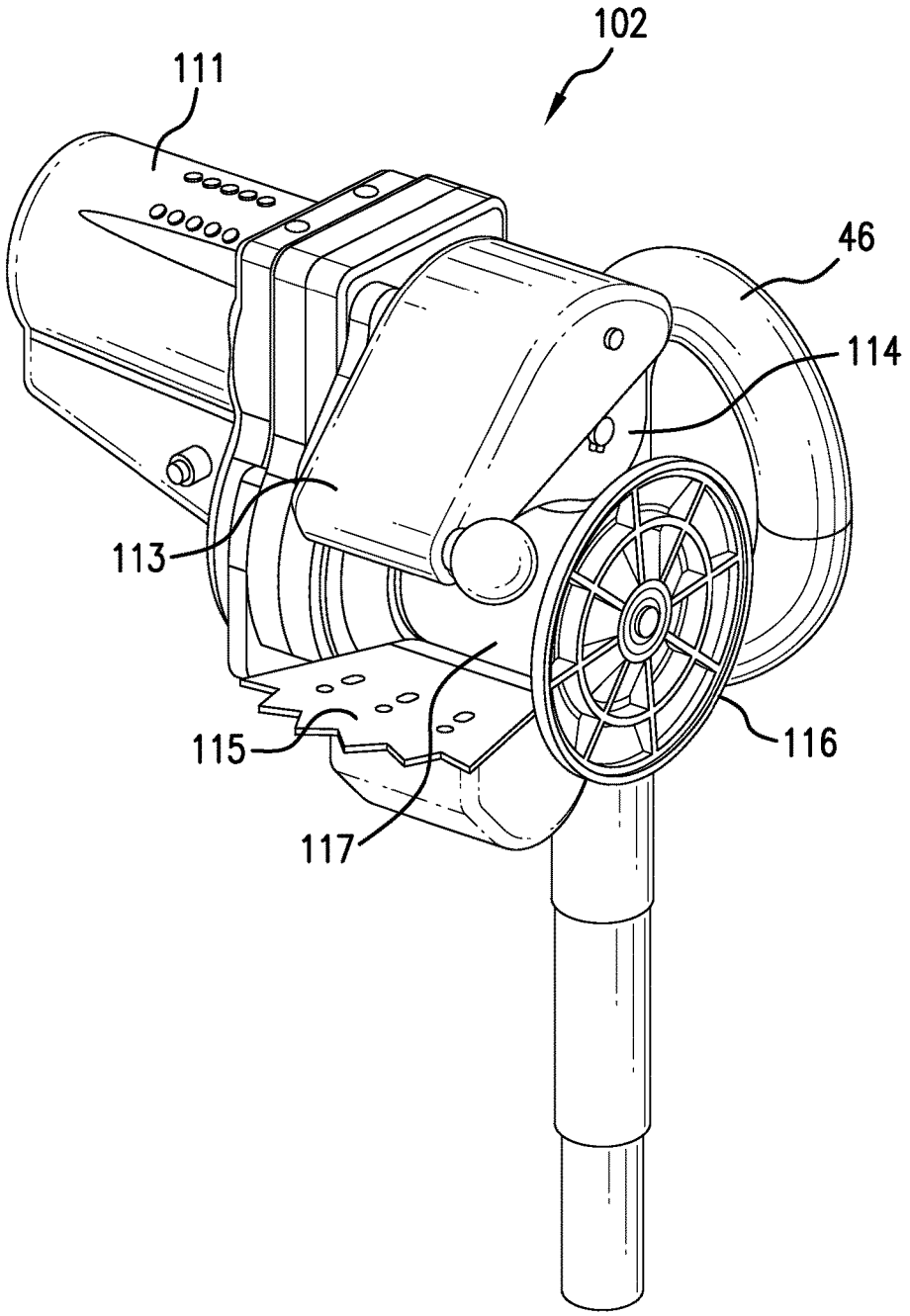
FIG. 14A is a front view of an embodiment of the converting station in accordance with the present disclosure.

In the preferred embodiment, as shown in FIG. 14A, the system 10 includes an actuator, such as an automated motor 111, for driving the material 19. The motor 111 can be connected to a power source, such as an outlet via a power cord, and can be arranged and configured for driving the system 10. The motor 111 may be part of a drive portion, and the drive portion may include a transmission portion for transferring power from the actuator. Alternatively, a direct drive may be used. The motor 111 can be arranged in a housing and can be secured to one side of the central housing. The transmission may be contained within the central housing and may be operably connected to a drive shaft of the motor and a drive portion thereby transferring motor power.

Figure 14B:
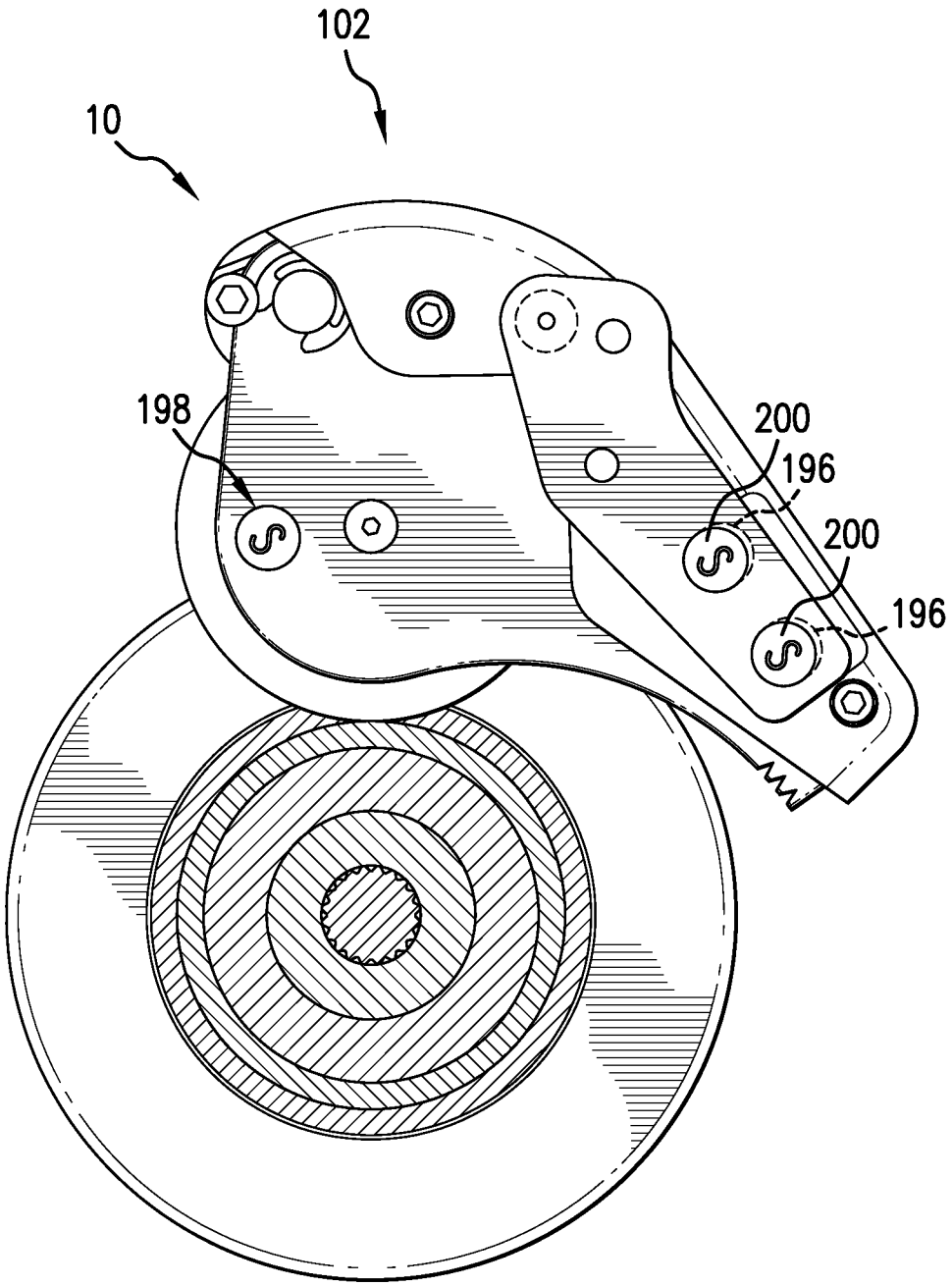
FIG. 14B is a cross-sectional, left-side view through the converting station of FIG. 14A.
Figure 15:
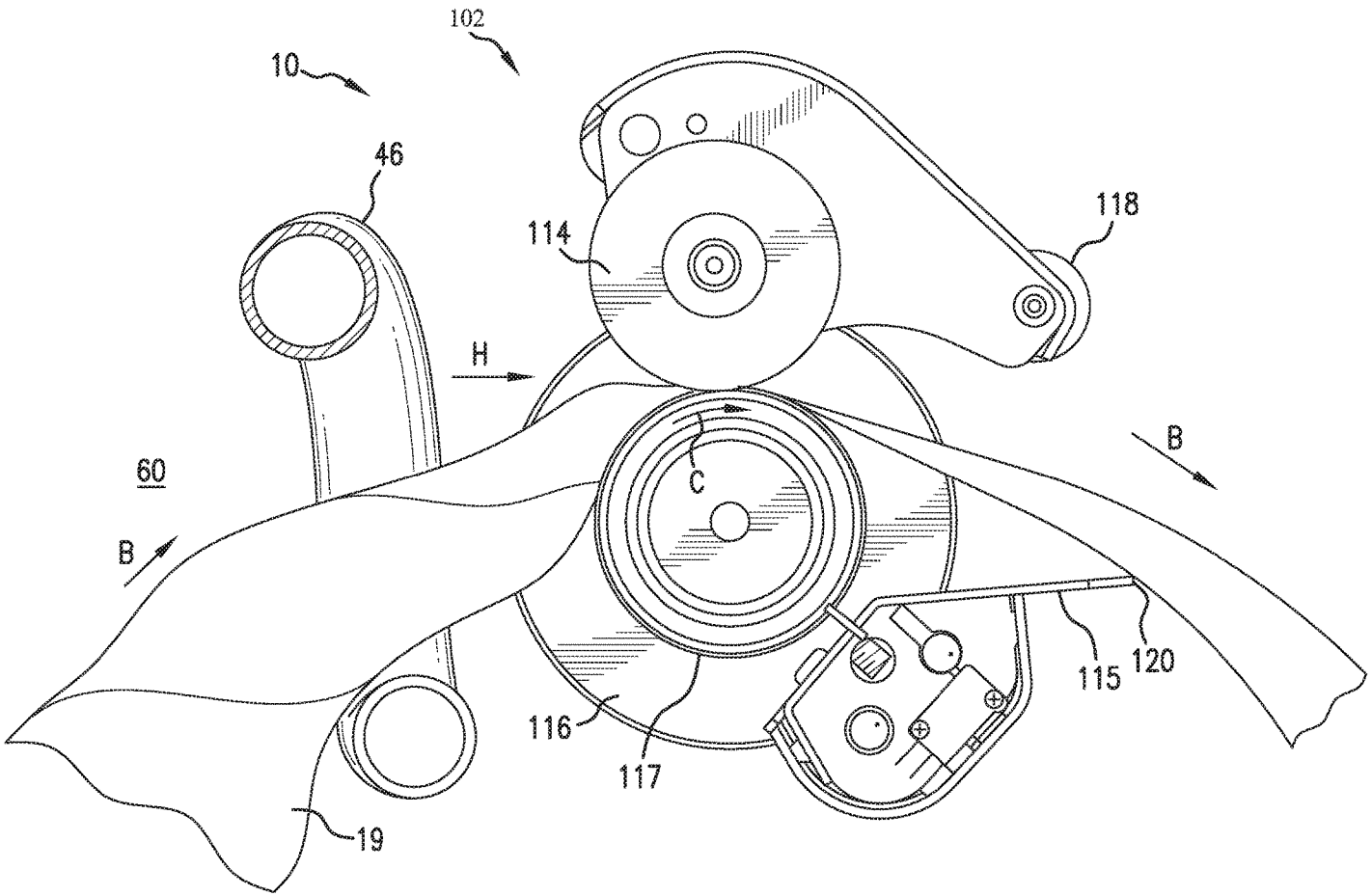
FIG. 15 is a side view thereof.
Figure 16:
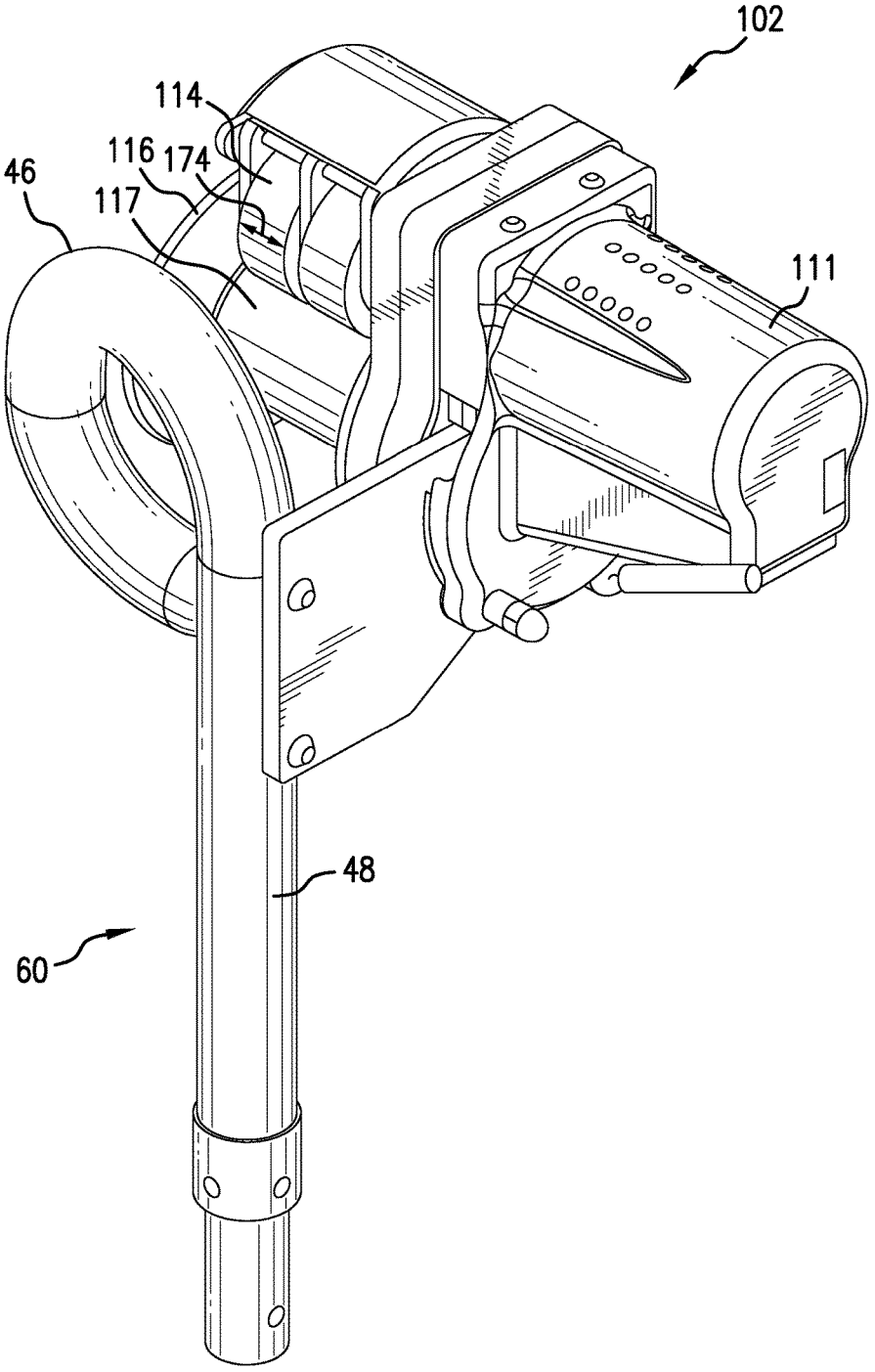
FIG. 16 is a rear view thereof.

In the embodiment shown in FIGS. 14-16, the converting station 102 includes a pressing portion 113 that can have a pressing member 114 such as a roller or rollers. The rollers 114 may be supported via a bearing or other low friction or frictionless device positioned on an axis shaft arranged along the axis of the rollers 114. The rollers 114 may have a circumferential pressing surface arranged in tangential contact with the surface of the drum 117. Preferably, the rollers 114 can be relatively wide 174 such as ¼ to ½ the width of the drum 117, and can have a diameter similar to the diameter of the drum 117, for example. It should be appreciated that other diameters of the rollers 114 may also be provided. For example, the diameter of the roller can be sufficiently large to control the incoming material stream. That is, for example, when the high speed incoming stream diverges from the longitudinal direction, portions of the stream may contact an exposed surface of the rollers, which may pull the diverging portion down onto the drum and help crush and crease the resulting bunching material.

The converting station 102 includes a pressing member, such as rollers 114, having an engaged position biased against the drum 117 for engaging and crushing the sheet material 19 passing therebetween against the drum 117 to convert the sheet material. The rollers 114 can have a released position displaced from the drum to release jams. The converting station 102 can have a magnetic position control system configured for magnetically holding the rollers 114 in each of the engaged and released positions. The position control system can be configured for exerting a greater magnetic force for retaining the pressing member 114 in the engaged position than for retaining the rollers 114 in the released position.

For example, the pressing portion 113, which can include the pressing member, can be disposed about a pivot axis such that, ignoring gravitational force, the pressing portion 113 is substantially free to pivot in a direction tending to separating the rollers 114 from the drum 117 about the pivot point. To resist this substantially free rotation, the pressing portion 113 can be secured in position by a position control system configured to maintain the rollers 114 in tangential contact with the drum 117, unless or until a sufficient separation force is applied, and hold the rollers 114 in a released position, once released. As such, when the material 19 passes between the drum 117 and the roller 114, the position control system can resist separation between the pressing portion 113 and the drum 117 thereby pressing the stream of sheet material and converting it into a low-density dunnage. When the rollers 114 are released due to a jam or other release causing force, the position control system can hold the rollers 114 in a released position allowing the jam to be cleared and preventing damage to the machine, jammed material, or human extremities, for example.

The position control system can include one or more biasing elements arranged and configured to maintain the position of the pressing portion 113 unless or until a separation force is applied. In the exemplary embodiment, the one or more biasing element can include a magnetic biasing element 196, as disclosed in U.S. Publication 2012/0165172. The magnetic biasing element 196, shown in FIG. 14B, is positioned behind magnets 200 disposed on the central housing. The magnetic biasing element 196 resists separation forces applied to the pressing portion 113. Additionally, the position control system can also include a release hold element 198, as shown in FIG. 14B, configured to hold the pressing portion 113 in the released open condition once the separation force has been applied and the pressing portion 113 has been released. In the exemplary embodiment, the released hold element can also be a magnetic holding element 198. It is noted that the nature of the magnets can provide the hold down force to require the minimum release force, that is the force applied to overcome the magnetic force of the biasing element, in a manner such that the hold-down force diminishes as the pressing portion 113 is separated from the drum 117. As such, the biasing force of the magnets can be substantially removed when the pressing portion 113 is pivoted to its released position.

Once in the pressing portion 113 is released, the magnets in the release hold element can function to hold the pressing portion 113 in the released condition. In one configuration, the force it takes to release the pressing portion 113 can be greater than the force required to place the pressing portion 113 back into an engaged position. This releasing mechanism can be advantageous to situations in which the user incorrectly positions the sticker on the supply unit, for example, and the supply units and sticker causes the converting station 102 to jam. In such situation, once the release force is reached due to the jam, the pressing portion 113 can release to a release position allowing for the user to easily remove the jam and preventing damage to the converting station 102.

In the exemplary embodiment shown in FIGS. 14-16, the motor 111 may be controlled by a user, for example, electrically, such as by operating a foot pedal, a switch, a button, or other control. The motor 111 is connected to a cylindrical driving drum 117 which is caused to rotate by the motor 111. This embodiment can also include one or more drum guides 116 arranged on axial ends thereof in a lateral position relative to the feed direction. The drum guides 116 can help to guide the sheet material toward the center of the drum 117. The drum guide 116 can be operably connected to the drum 117 to rotate freely with or without the drum 117. As such, the drum guide 116 may be supported off of the drive shaft of the drum 117 via a bearing or other isolating element for allowing the drum guide 116 to rotate relative to the drum 117. In addition, the drum guide 116 may be isolated from the axial side of the drum 117 by an additional space, bearing, or other isolation element for minimizing the transfer of rotational motion from the drum 117 to the guide 116. In other embodiments, the outer drum guide 116 may be supported via a bearing off of the outer axial side of the drum 117 rather than off of the drive shaft, for example. While a drum 117 connected with a motor 111 is disclosed in this embodiment as the driving portion for driving the line of material in the dispensing direction, it will be appreciated that other feed methods are possible, such as an automated motor.

During operation, the motor 111 dispenses the sheet material 19 by driving it in a dispensing direction, generally indicated by arrows "B" in FIG. 15. The supply material 19 is fed over the drum 117, thereby causing the material 19 to be driven in the dispensing direction when the motor 111 is in operation. As the material 19 is fed through the system 10 in the feeding or dispensing direction "B", including rotation of the drum 117 in the direction "C", it passes over a cutting member 115. The cutting member 115 can be curved or extend straight downstream the dispensing direction "B" so as to provide a guide for the path of the material 19 as it exits the system. The cutting member 115 includes a sharp cutting point 120 at the leading tip thereof, which may be a toothed configuration.

It is appreciated that other types of crumpling stations known in the art can also be used, such as, for example, material be crumpled by pulling through a restricted space provided by a funnel, roller oriented at various angles, or other mechanism known in the art.

In one embodiment, a tear-assist apparatus can optionally be provided to move the material 19 in a direction opposite the pulling direction, or a reverse direction. For example, the reverse movement may occur upon the user pulling the material 19 in a downward direction and engaging the material 19 with the cutting member 115. Where a cutter 115 is provided, the tear-assist apparatus pulls the material 19 in reverse to engage with the cutter 115 to more easily sever the material 19. However, a cutting member 115 does not need be present, for example where the material 19 is perforated, and the tear-assist may function to assist the user to sever the material 19 at the perforation.

The reverse movement of the tear-assist apparatus can be caused by a spring, a motor, which can be the motor 111 as shown, an alternate motor, or other mechanical members.

Further, a sensing unit can be provided in some embodiments. The sensing unit can be operable to sense the pulling motion initiated by the user. As the user pulls on the material 19, the sensing unit detects a movement in the dispensing direction. The sensing unit can detect pulling initiated only by the user. When this movement is detected, the sensing unit sends a signal to the driving portion to initiate a short rotational force in the direction opposite the dispensing direction, thereby causing the material 19 to be pulled in a direction opposite what the user is pulling. The tear-assist thereby assists the user in tearing the material 19. It is appreciated that the tear-assist apparatus is an optional feature that can be provided in some configurations, but that the tear-assist apparatus can be omitted. Further, other suitable types of tear-assist apparatuses or cutting mechanisms can be provided for severing the material 19, or the line of material 19, in some embodiments, can be perforated to facilitate severing the material 19.

As shown in FIG. 16, the system 10 preferably can include a support portion 48 for supporting the station 102 and an inlet guide 46 for guiding the sheet material into the converting station 102. In the embodiment shown, the support portion 48 and the inlet guide 46 are shown combined into a single rolled or bent spine 60 forming a support pole or post. In this particular embodiment, the elongate element 60 is a tube having a round pipe-like cross-section. Other cross-sections may be provided.

In one configuration, as illustrated in FIG. 1, the converting station 102 and supply handling unit 51 can be affixed to the same elongated element, or spine 60, and share the same floor base 62. The floor base 62 preferably includes wheels, which in some embodiments can include a locking mechanism, for easy movement. In yet other configurations, for example as shown in FIG. 12, the converting station 102 can have a floor base 64 separate from the floor base 66 of the supply handling units 51. Having separate floor bases allows for the user to easily remove and position stacks of supply units into the converting station 102. For example, a user can position a stabilizer 52 having supply units such that the units are fed into converting station 102. Once the supply units within the stabilizer 52 have been converted, the user can remove the stabilizer 52 and position a second stabilizer 52 having supply units in its place without moving the converting station 102. This allows for multiple stabilizers 52 to be pre-loaded with rolls, and the user can easily transport and align the pre-loaded stabilizer 52 with the converting station 102 for converting the rolls into a low-density material. Once the rolls are depleted, the user can move out the stabilizer 52 and align a subsequent pre-loaded stabilizer 52 with the converting station 102 for converting the rolls, and so on.

Figure 17:
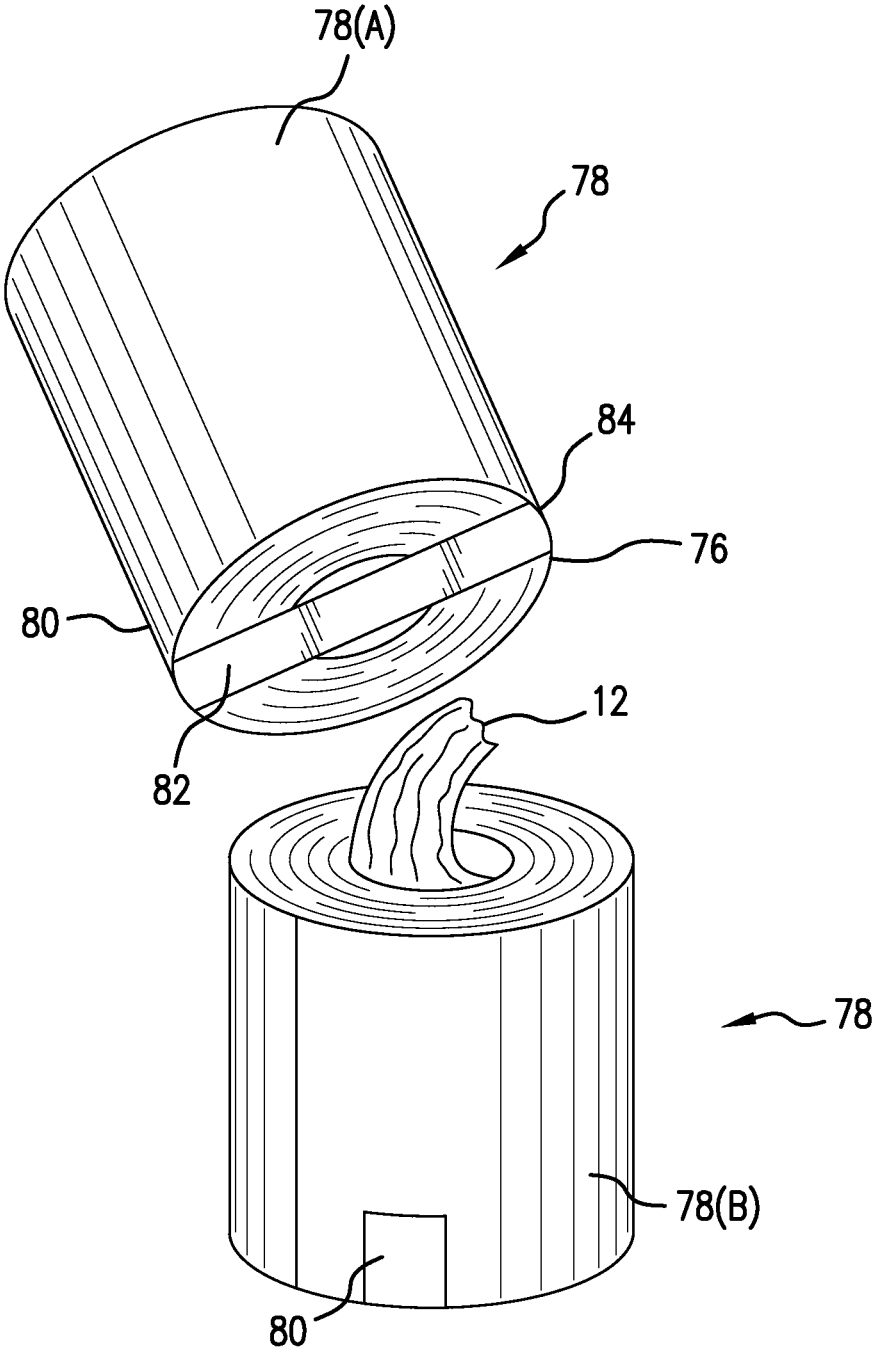
FIGS. 17 and 18 depict supply units according to other embodiments.

FIG. 17 illustrates an additional exemplary configuration of daisy-chaining or connecting multiple supply units, such as rolls 78, to form an uninterrupted feed of sheet material. FIG. 17 depicts two rolls 78(A),78(B) being stacked on each other. Each roll 78 may include a receiving strip 76 that includes a tacky, sticky, or otherwise attachable material (e.g., an adhesive). The receiving strip 76 can have an adhesive coating on the exterior layer or side, the interior layer or side, or both the exterior and interior layers or sides of the strip 76. The exterior layer or side being defined as the portion of the receiving strip 76 facing outwardly and configured to attach to the inner end 12 of a preceding roll 78. The interior layer or side being defined as facing inwardly and opposite the exterior side.

In other embodiments, the receiving strip 76 further comprises a center portion 82 and two side portions 80 and 84. The side portions 80 and 84 can be positioned on either side of the rolls 78(A),78(B). The side portions 80 and 84 can have an adhesive coating on the interior side of the side portion such that the side portions 80 and 84 sufficiently adheres to the side of the rolls 78.

Each roll 78 comprises an inner end 12 protruding from the inside of the roll 78. In the initial state, the inner end 12 may already be protruding from the inside of the unit 4, or the end 12 may need to be manually pulled from the center of the unit. When one roll 78(A) is stacked on top of another roll 78(B), the adhesive coating of strip 76 can bond with the inner end 12. Preferably, the inner end 12 bonds with the center portion 82 of the strip 76, such that the bond between the strip 76 and inner end 12 is further strengthened through the pressure of the weight of roll 78(A) when stacked vertically. Preferably, the bond created by the adhesive coating on the exterior side of the receiving strip 76 is stronger than the bond created by the adhesive coating on the interior side of the receiving strip 76. The strip 76, including the center portion 82 and side portions 80 and 84, may include an adhesive coating on both sides of the strip 76 (i.e. the exterior and interior layers), in just certain areas, or on just one side of the strip 76.

The exemplary embodiment shown in FIG. 17 includes an adhesive on substantially all or both the exterior and interior sides of receiving strip 76. In this configuration, when the roll 78(A) comprises a roll, as illustrated in FIG. 17, the center portion 82 of the strip 76 adheres to multiple edges (e.g., one per turn on either side of the strip). The combined surface area of each thin edge can provide a combined adhesion to hold strip 76 to the bottom of roll 78(B). At the same time, because the adhesive bond between that one layer edge and the center portion 82 of the receiving strip 76 can be relatively weak in some embodiments, the arrangement still allows for the converting station 102 or dunnage supply mechanism to pull the supply material away from the roll one layer at a time.

Further, by protruding the inner end 12 of the next roll (e.g. 78(B)), such as by crumpling the end into a larger protrusion, or merely pulling out a flat portion of the material, the inner end 12 can automatically couple with center portion 82 of the receiving strip 76 once stacked, because inner end 12 can include sufficient surface area to create a sufficiently strong bond with the exterior adhesive coating of the center portion 82 of the receiving strip 76 to pull the connected strips through the converting station 102 without breaking or jamming the device. Once the preceding roll 78(A) reaches the end of its material supply, the side portions 80 and 84, being in contact with the surface of the supply material and not just the edge of that material, can ensure that the end of the supply material pulls along receiving strip 76, via side portion 80 and 84, and thereby pulls along the inner end 12 of the next roll 78(B).

In alternative embodiments of the exemplary configuration, the interior layer of the center portion 82 of the receiving strip 76 does not have an adhesive quality, and the side portions 80 and 84 act as the primary coupling of receiving strip 76 to the roll 78(A). In other configurations, the exterior layer of strip 76 can include an adhesive quality along its full length, only on the area expected to contact the inner end 12 of a second roll 78(B), or in some other area, such as only on the exterior layers of the side portions 80 and 84. In embodiments where the adhesive coating is located in an area that does not align with the inner end 12, the configuration can require a user to pull the inner end 12 out further, and manually affix it to the adhesive area when loading/stacking the supply units, for example onto the exterior layer of the side portions 80 and 84. Further, the strip 76 can include a protective layer, such as wax paper or anything else configured to protect the adhesive coating or layer until the protective layer is removed.

In addition to the receiving strip 76, as illustrated in FIG. 17 the strip 76 can have other shapes and configurations other than a longitudinal strip to capture more angles of the inner end 12 of proceeding units. Further, alternative embodiments can include a receiving strip 82 without any side portions 80 or 82, or with only one side portion 80.

Figure 18:
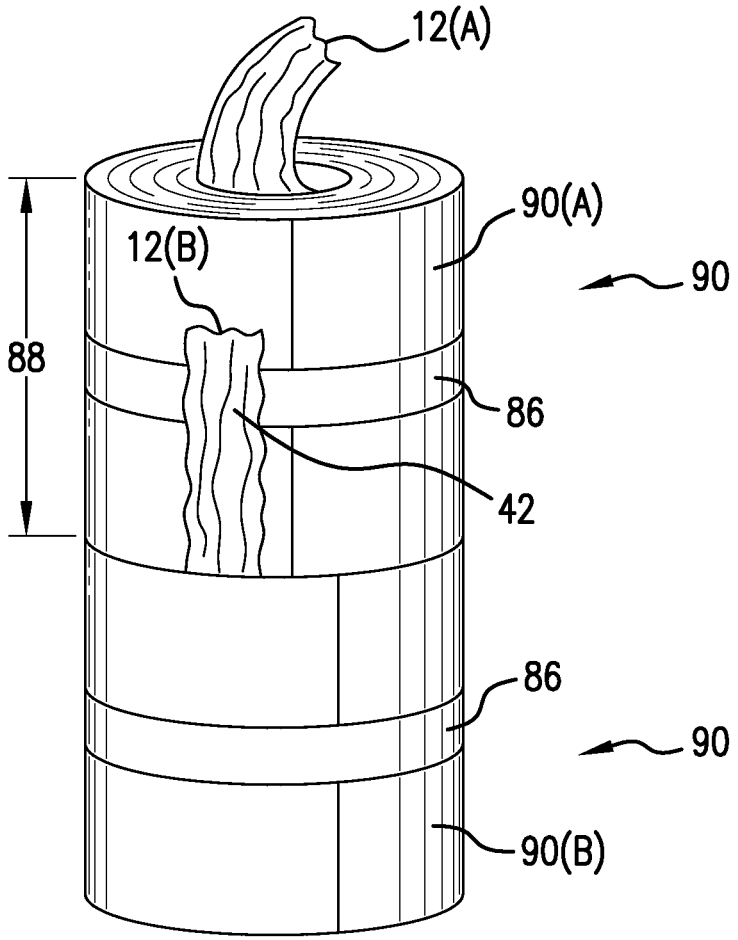

FIG. 18 illustrates yet another exemplary embodiment of daisy-chaining or connecting multiple supply units, such as rolls 90, to form an uninterrupted feed of sheet material. FIG. 18 illustrates two rolls 90(A),90(B) in a stacked configuration. The upper supply unit 90(A) includes an inner end 12(A) having a connecting portion 42, similar to that described in FIGS. 1-6B, and an adhesive strip 86 encircling the outer layer of the supply unit. Preferably, the adhesive strip 86 is positioned about the center or middle of the supply unit height 88, but in other embodiments, the adhesive strip 86 could be positioned elsewhere along the height 88 of the supply unit, such as the bottom or top of the outer layer, or the bottom surface, such as the exemplary embodiment illustrated in FIG. 17.

The inner end 12(A) is illustrated in FIG. 18 as protruding from the inner portion of the upper unit 90(A). However, it is appreciated that initially the inner ends 12 of the supply units could be protruding from the inner portion of the unit or could be fully within the inner portion of the unit, which may require removal of that end 12 during loading. Regardless of its initial position, the connecting portion 42 of the inner end 12(B) of a lower unit 90(B) can be affixed to strip 86 of the upper supply unit 90(A), thus forming a continuous chain between the two units. Similar to the adhesive strip discussed in FIG. 17, the adhesive strip 86 in FIG. 18 can include an adhesive quality on both the interior and exterior sides, one side, or any portion of either side. The adhesive strip 86 may also include a removable protecting layer. The exterior side being defined as the portion of the adhesive strip 86 facing outwardly and configured to attach to the inner end 12 of a bottom or second supply unit. The interior side being defined as facing inwardly and opposite the exterior side.

The adhesive strip 86 may fully encircle unit 90(A) and 90(B), as shown in FIG. 18, or may be present on only part of unit 90(A) and 90(B). Further, while only one adhesive strip 86 is illustrated, each unit may include multiple and/or differing numbers of strips, which may be selected from by an end-user, or may be used in combination for added connection strength.

In an alternative configuration, multiple supply units can be fed into the converting station 102 in parallel and the sticker 6 can be used to connect the inner ends 12 of the plurality of units. For example, the inner end of one supply unit or roll can be connected to another supply unit or roll. As described above, the sticker 6 can be initially disposed on one inner end 12 of one roll with the release layer 20 on the sticker's connecting member 16. Once the release layer 20 is removed, the connecting member 16 can connect the inner end with the inner end of another roll. Alternatively, the sticker 6 can be initially provided separately from the supply units. As described above, in alternative embodiments, sticker 6 can further include an additional release layer that lines the connecting member 16, or base member 18, or both (either as two individual release layers or one unified release layer). The user can then lift the additional release layer or layers from the sticker 6 and adhere it to the inner ends 12 of the rolls. The inner end of one roll can overlap the inner end of the other roll, or the inner ends can be disposed adjacent to each other with the sticker connecting the two. It is noted that although daisy chaining the supply rolls is disclosed above as being accomplished via stickers, other methods can be used, such as adhesives applied directly to the material of the rolls, or other fastening members such as staples or clips.

Other aspects and configurations of the converting station are provided for in U.S. application Ser No. 61/537,021 and U.S. Publication No. 2012/0165172, both hereby fully incorporated by reference. U.S. application Ser. No. 13/566,659 is also hereby fully incorporated by reference.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the disclosure are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present disclosure.

What is claimed is:

1. A rolled sheet-material supply handling-system, comprising:

a drawing device configured to draw paper sheet material from a supply station; and a stabilizer at the supply station defining a generally tubular roll-receiving space in which a roll of the paper sheet material is receivable, the stabilizer having a support surface that defines an axial opening leading from the roll-receiving space to receive the sheet material drawn therefrom by the drawing device, wherein the support surface is configured to be sufficiently extensive about a circumference of the roll in order to stabilize an outer layer of a roll of dunnage paper against collapsing under its own weight when the remainder of the roll has been pulled axially from a center of the roll and extracted from the axial opening, and wherein the stabilizer comprises a support wall that includes the support surface and two opposed ends at opposite circumferential sides of the support surface, the ends being movable with respect to each other.

2. The supply handling-system of claim 1, wherein the support surface is configured to compress against the outer layer of the roll sufficiently gently to prevent collapsing of the roll when the remainder of the roll has been extracted from the axial opening, and without causing significant deformation of the roll.

3. The supply handling system of claim 1, wherein the stabilizer is oriented generally upright, such that the axial opening is at the top of the stabilizer.

4. The supply handling system of claim 1, wherein the support surface is disposed to support at least three points disposed in a coverage angle of more than half of roll-receiving space circumference to support the outer layer of the roll against collapsing.

5. The supply handling system of claim 4, wherein the support surface is substantially continuous over the circumferential coverage angle.

6. The supply handling system of claim 1, wherein the support surface is resiliently biased into the roll-receiving space to press on the outer layer of the roll.

7. The supply handling system of claim 1, further comprising a roll received in the roll-receiving space.

8. The supply handling system of claim 7, wherein:

the roll-receiving space is substantially cylindrical; and the support surface is radially biased to a circumference smaller than the roll.

9. The supply handling system of claim 1, wherein the ends are resiliently movable with respect to each other.

10. The supply handling system of claim 9, wherein the support wall is flexible to allow the ends to move with respect to each other.

11. The supply handling system of claim 1, wherein the opposed ends are hinged with respect to each other to move with respect to each other.

12. The supply handling system of claim 1, wherein the support wall is tubular with an open axial portion between the opposed ends.

13. The supply handling system of claim 1, wherein the support surface is biased inwardly into the roll receiving space sufficiently gently to press against the outer surface of the roll to support the outer layer of the roll against collapsing when the remainder of the roll has been extracted, and without causing significant deformation of the roll.

14. The supply handling system of claim 1, wherein the support surface has an axial height sufficient to hold a plurality of rolls stacked on each other in the roll-receiving space.

15. The supply handling system of claim 14, further comprising the plurality of rolls stacked coaxially in the roll receiving space and daisy chained to each other, the outer surface of a preceding one of the stacked rolls that is daisy chained to a subsequent one of the stacked rolls being in supported contact with the support surface.

16. The supply handling system of claim 1, further comprising a preceding and a subsequent second roll, the preceding roll received in the stabilizer, and an outer end of the preceding roll daisy chained to an inner end of the subsequent roll, the stabilizer supporting the outer layer of the preceding roll against collapsing when the remainder of the roll has been extracted.

17. The supply handling system of claim 16, wherein the subsequent roll is received in the stabilizer.

18. The supply handling system of claim 17, wherein the rolls are coreless.

19. The supply handling system of claim 1, further comprising an adhesive strip adhering an inner end of one of the rolls to an outer end of a preceding one of the rolls.

20. The supply handling system of claim 1, wherein the stabilizer comprises a plurality of stabilizer units aligned coaxially with respect to each other, and each stabilizer unit is openable separately and independently from each other.

21. The supply handling system of claim 1, further comprising a converting station configured to convert the roll into low-density dunnage.

22. The supply handling system of claim 21, wherein the converting station includes the drawing device.

23. The supply handling system of claim 22, wherein the converting station includes a rotating drum configured for pulling and crushing the sheet material for converting the sheet material.

24. The supply handling-system of claim 1, wherein support surface is a cylindrical wall that defines the tubular space.

25. The supply handling-system of claim 24, wherein the support surface disposed substantially continuously along the wall.

26. The supply handling-system of claim 1, wherein the support surface extensively contacts at least about 60% of the circumference of the outer layer of the roll.

27. The supply handling-system of claim 1, wherein the support surface extends about the cylindrical space from a first perimeter end to a second perimeter end, the first and second perimeter ends spaced from one another to define an opening having an arc length that is at least about 20% of the circumference of the cylindrical space.

28. The rolled sheet-material supply handling-system of claim 1, wherein the support surface is arcuate and configured to be continuously extensive over a coverage angle of at least 40% of the perimeter of the roll.

29. A dunnage apparatus, comprising:

a converting station comprising:

a drawing device configured to draw paper sheet material from a supply station;

and a converter having a rotating drum configured for pulling and crushing the sheet material for converting the sheet material into dunnage; and an arcuate stabilizer at the supply station defining a tubular roll-receiving space in which a roll of the paper sheet material is receivable, and having a cylindrical support surface that defines the tubular roll-receiving space and an axial opening leading from the roll-receiving space to receive the sheet material drawn therefrom by the drawing device, wherein the cylindrical support surface is configured to be sufficiently extensive about a circumference of the roll in order to stabilize an outer layer of a roll of dunnage paper against collapsing under its own weight when the remainder of the roll has been extracted from the axial opening, and wherein the stabilizer comprises a support wall that includes the cylindrical support surface and two opposed ends at opposite circumferential sides of the support surface, the ends being movable with respect to each other.

30. The supply handling-system of claim 29, wherein the cylindrical support surface extends arcuately about the roll-receiving space from a first perimeter end to a second perimeter end, the first and second perimeter ends spaced from one another to define an opening that has an arc length that is at least about 20% of the circumference of the cylindrical space.

31. A rolled sheet-material supply handling-system, comprising:

a converting station comprising:

a drawing device configured to draw paper sheet material from a supply station, and a converter having a rotating drum configured for pulling and crushing the sheet material for converting the sheet material into dunnage;

a roll of dunnage paper sheet material configured to crease by the crushing of the converter to produce dunnage; and a stabilizer at the supply station defining a tubular roll-receiving space in which the roll of dunnage paper sheet material is received, the stabilizer having a support surface that defines an axial opening leading from the tubular roll-receiving space to receive the sheet material drawn therefrom by the drawing device, and the support surface configured to contact an outer layer of the roll at sufficient circumferential locations in order to stabilize the outer layer of the roll of dunnage paper sheet material against collapsing under its own weight when the remainder of the roll has been pulled axially from a center of the roll and extracted from the axial opening, wherein the support surface has opposed ends arranged at opposite circumferential sides of the support surface to enable loading of a plurality of rolls of the dunnage paper sheet material.

32. The rolled sheet-material supply handling-system of claim 31, wherein the roll is generally cylindrical, and the support surface is cylindrical to follow a contour of the roll.

33. The supply handling system of claim 31, wherein the opposite circumferential sides define an opening therebetween.

34. The supply handling system of claim 31, wherein the opposite circumferential sides of the support surface are movable in relation to each other to allow for loading of the rolls.

* * * * *